US009560917B2

(12) United States Patent
Roslund, Jr.

(10) Patent No.: US 9,560,917 B2
(45) Date of Patent: Feb. 7, 2017

(54) RECLINE ADJUSTMENT SYSTEM FOR CHAIR

(71) Applicant: Steelcase Inc., Grand Rapids, MI (US)

(72) Inventor: Richard N. Roslund, Jr., Jenison, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/833,816

(22) Filed: Aug. 24, 2015

(65) Prior Publication Data

US 2016/0143443 A1 May 26, 2016

Related U.S. Application Data

(60) Provisional application No. 62/084,986, filed on Nov. 26, 2014.

(51) Int. Cl.

| | |
|---|---|
| ***A47C 3/026*** | (2006.01) |
| ***A47C 1/024*** | (2006.01) |
| ***A47C 1/032*** | (2006.01) |
| ***A47C 1/033*** | (2006.01) |
| ***A47C 7/44*** | (2006.01) |
| ***A47C 7/00*** | (2006.01) |
| ***A47C 7/02*** | (2006.01) |
| ***A47C 7/14*** | (2006.01) |

(52) U.S. Cl.

CPC ..... *A47C 7/44* (2013.01); *A47C 7/004* (2013.01); *A47C 7/025* (2013.01); *A47C 7/14* (2013.01); *A47C 7/441* (2013.01); *A47C 7/445* (2013.01)

(58) Field of Classification Search

CPC ..... A47C 7/44; A47C 7/441; A47C 7/445; A47C 7/004; A47C 7/14; A47C 7/025

USPC ..... 297/285, 296, 297, 300.7, 300.8

See application file for complete search history.

(56) References Cited

U.S. PATENT DOCUMENTS

| | | | |
|---|---|---|---|
| 54,828 | A | 5/1866 | Carre |
| 144,349 | A | 11/1873 | Morrison et al. |
| 198,421 | A | 12/1877 | Smith |
| 389,033 | A | 9/1888 | Wetmore |
| 614,997 | A | 11/1898 | Smith |
| 1,305,042 | A | 5/1919 | White |
| 1,491,918 | A | 4/1924 | Nolan |
| 1,777,463 | A | 10/1930 | Dearing |
| 2,316,628 | A | 4/1943 | Schaffner |

(Continued)

FOREIGN PATENT DOCUMENTS

| | | | |
|---|---|---|---|
| DE | 3118175 | A1 | 11/1982 |
| EP | 0405681 | A1 | 1/1991 |
| WO | 2006047143 | A2 | 5/2006 |

*Primary Examiner* — Rodney B White

(74) *Attorney, Agent, or Firm* — Price Heneveld LLP

(57) ABSTRACT

A seating arrangement includes a base support, a support arrangement movable between upright and reclined positions, and a spring arrangement that includes a first portion attached to the support arrangement, a second portion attached to the base support, an intermediate portion positioned between the first and second positions, first and second members configured to bias the support arrangement from the reclined position toward the upright position, the second spring member spaced from the first spring member, and an adjustment member positioned between the first and intermediate portions, the adjustment member adjustable between positions that adjust the force exerted by the first and second spring on the support arrangement.

20 Claims, 21 Drawing Sheets

(56) References Cited

U.S. PATENT DOCUMENTS 2,353,737 A 7/1944 Lorenz
2,440,172 A 4/1948 Gibbons
2,516,773 A 7/1950 Infranca et al.
2,649,146 A 8/1953 Sanford et al.
2,731,078 A 1/1956 Cadman et al.
2,818,911 A 1/1958 Syak
2,993,733 A 7/1961 Pinkham
D192,165 S 2/1962 Brandon
3,081,077 A 3/1963 Sudman
3,133,765 A 5/1964 Kramer
3,165,307 A 1/1965 Edwards
D200,640 S 3/1965 Lombard, III
3,201,172 A 8/1965 Bliss
D207,955 S 6/1967 Rodrigo
3,353,869 A 11/1967 Getz et al.
3,399,883 A 9/1968 McKey
3,403,880 A 10/1968 Rude
3,512,831 A 5/1970 Flint
3,557,264 A 1/1971 Getz et al.
3,563,540 A 2/1971 Hopfeld
3,583,759 A 6/1971 Kramer
3,593,953 A 7/1971 Auer
3,740,096 A 6/1973 Bridger
D227,829 S 7/1973 Klose
3,756,656 A 9/1973 Weick
3,841,704 A 10/1974 Platner et al.
3,883,176 A 5/1975 Morton
4,032,190 A 6/1977 Muller-Deisig et al.
D255,184 S 6/1980 Locher
4,418,958 A 12/1983 Watkin
4,498,702 A 2/1985 Raftery
4,519,651 A 5/1985 Whitwam
4,529,247 A 7/1985 Stumpf et al.
4,585,272 A 4/1986 Ballarini
D289,120 S 4/1987 Chadwick et al.
4,660,887 A 4/1987 Fleming et al.
4,744,603 A 5/1988 Knoblock
4,786,106 A 11/1988 Bottemiller
4,790,595 A 12/1988 Hensel et al.
4,790,598 A 12/1988 Locher
4,856,845 A 8/1989 Massonnet
4,856,846 A 8/1989 Lohmeyer
4,889,385 A 12/1989 Chadwick et al.
4,892,356 A 1/1990 Pittman et al.
4,911,501 A 3/1990 Decker et al.
D307,221 S 4/1990 Mudge
4,913,493 A 4/1990 Heidmann
4,938,530 A 7/1990 Snyder et al.
5,015,038 A 5/1991 Mrotz, III
5,026,117 A * 6/1991 Faiks ..... A47C 3/026 297/300.7 X
5,046,780 A 9/1991 Decker et al.
5,050,931 A 9/1991 Knoblock
5,076,646 A 12/1991 Matte
5,100,201 A 3/1992 Becker, III et al.
5,102,196 A 4/1992 Kaneda et al.
5,121,934 A 6/1992 Decker et al.
5,123,702 A 6/1992 Caruso
5,145,234 A 9/1992 Gualtierotti et al.
5,279,528 A 1/1994 Dalebout et al.
5,314,240 A 5/1994 Ishi et al.
5,333,934 A 8/1994 Knoblock
5,338,099 A 8/1994 Ishi et al.
5,340,197 A 8/1994 Vogtherr
D351,744 S 10/1994 Caruso et al.
5,352,022 A 10/1994 Knoblock
D358,514 S 5/1995 Lovegrove
5,411,316 A 5/1995 Lovegrove et al.
5,487,591 A 1/1996 Knoblock
D367,982 S 3/1996 Stirling et al.
5,505,521 A 4/1996 Meiller et al.
5,551,753 A 9/1996 Glöckl
5,567,012 A 10/1996 Knoblock
5,573,304 A 11/1996 Glöckl
5,577,811 A 11/1996 Ogg
5,599,064 A 2/1997 Vanderminden, Sr.
5,611,598 A 3/1997 Knoblock
5,725,277 A 3/1998 Knoblock
5,806,930 A 9/1998 Knoblock
5,810,438 A 9/1998 Newhouse
5,827,155 A 10/1998 Jensen et al.
5,997,094 A 12/1999 Cvek
6,099,075 A 8/2000 Watkins
6,186,594 B1 2/2001 Valiquette et al.
6,250,715 B1 6/2001 Caruso et al.
6,257,665 B1 * 7/2001 Nagamitsu ..... A47C 7/405 297/285
6,367,876 B2 4/2002 Caruso et al.
6,386,636 B2 5/2002 Caruso et al.
6,409,268 B1 6/2002 Cvek
6,412,869 B1 7/2002 Pearce
6,422,650 B1 7/2002 Chien-Shen
6,511,128 B2 1/2003 Piretti
6,536,841 B1 3/2003 Pearce et al.
6,588,843 B1 * 7/2003 Ebenstein ..... A47C 1/03238 297/300.8 X
6,598,937 B2 7/2003 Caruso et al.
6,634,717 B2 10/2003 Kown
6,722,735 B2 4/2004 Lucci et al.
6,752,458 B1 6/2004 Rivera
6,779,846 B2 8/2004 Spendlove et al.
6,783,184 B2 8/2004 DiBattista et al.
6,786,548 B2 9/2004 Heidmann et al.
6,811,218 B2 11/2004 Deimen et al.
6,871,909 B2 * 3/2005 Hobb ..... A47C 3/026 297/300.8
6,877,813 B2 4/2005 Caruso et al.
6,880,886 B2 4/2005 Bodnar et al.
6,896,328 B2 5/2005 Goodworth
6,913,317 B2 7/2005 Vanderminden et al.
6,932,430 B2 8/2005 Bedford et al.
6,935,690 B2 8/2005 Lucci et al.
D510,668 S 10/2005 Eldøy
7,004,543 B2 2/2006 Caruso et al.
D516,345 S 3/2006 Goodworth
D516,831 S 3/2006 Eldøy
7,021,712 B2 4/2006 Spendlove et al.
7,032,971 B2 4/2006 Williams
7,048,335 B2 5/2006 Norman et al.
D525,445 S 7/2006 Liu et al.
D525,446 S 7/2006 Farber
7,097,249 B2 8/2006 Igarashi et al.
7,175,232 B2 2/2007 Rivera
7,226,127 B1 * 6/2007 Yevko ..... A47C 7/44 297/296 X
7,226,130 B2 6/2007 Tubergen et al.
7,237,841 B2 7/2007 Norman et al.
D553,380 S 10/2007 Natuzzi
D559,002 S 1/2008 Williams et al.
7,334,845 B2 2/2008 Peterson et al.
7,360,835 B2 4/2008 Tubergen et al.
7,458,637 B2 12/2008 Norman et al.
D596,871 S 7/2009 Farber
7,568,763 B2 8/2009 Bedford et al.
7,600,820 B2 10/2009 Bouche et al.
7,708,349 B2 5/2010 Chen
7,789,378 B2 9/2010 Dittmar
7,806,476 B2 10/2010 Forgatsch et al.
7,857,390 B2 12/2010 Schmitz et al.
7,896,439 B2 3/2011 Kan et al.
7,926,880 B2 4/2011 Heidmann et al.
7,992,936 B2 8/2011 Schmitz et al.
7,992,937 B2 8/2011 Plikat et al.
8,025,334 B2 9/2011 Schmitz et al.
8,025,335 B2 9/2011 Gehner
8,029,060 B2 10/2011 Parker et al.
8,087,727 B2 1/2012 Parker et al.
8,096,615 B2 1/2012 Parker et al.
8,162,397 B2 4/2012 Booth et al.
8,272,691 B2 * 9/2012 Hsuan-Chin ..... A47C 7/402 297/285 X
D669,279 S 10/2012 EldøY
8,282,172 B2 10/2012 Schmitz et al.
8,313,140 B2 11/2012 Niitsuma et al.

(56) References Cited

U.S. PATENT DOCUMENTS

| | | | | |
|---|---|---|---|---|
| 8,414,073 | B2 | 4/2013 | Schmitz et al. | |
| 8,500,204 | B2 | 8/2013 | Kemp | |
| 8,562,073 | B2 | 10/2013 | Niitsuma et al. | |
| 8,567,864 | B2 | 10/2013 | Deisig et al. | |
| 8,585,026 | B2 | 11/2013 | Dittmar | |
| 8,613,481 | B2 | 12/2013 | Parker et al. | |
| 8,616,640 | B2 | 12/2013 | van Hekken | |
| 8,657,374 | B2 | 2/2014 | Higgs | |
| 8,668,265 | B2 | 3/2014 | Parker et al. | |
| 2002/0000745 | A1 | 1/2002 | Conte | |
| 2003/0025370 | A1* | 2/2003 | Hensel | A47C 7/38<br>297/285 |
| 2004/0217521 | A1 | 11/2004 | DiBattista et al. | |
| 2004/0224127 | A1 | 11/2004 | DiBattista et al. | |
| 2004/0262977 | A1 | 12/2004 | Dibattista et al. | |
| 2007/0205648 | A1 | 9/2007 | Huang | |
| 2007/0267912 | A1 | 11/2007 | Britton et al. | |
| 2007/0273190 | A1 | 11/2007 | Gehner | |
| 2009/0091170 | A1 | 4/2009 | Grentzelius et al. | |
| 2010/0060057 | A1 | 3/2010 | Ballendat | |
| 2011/0089740 | A1 | 4/2011 | Dennehy | |
| 2012/0091769 | A1 | 4/2012 | Parker et al. | |
| 2012/0228911 | A1 | 9/2012 | Piretti | |
| 2012/0299350 | A1 | 11/2012 | Willingham | |
| 2013/0313875 | A1 | 11/2013 | Brncick et al. | |
| 2014/0077573 | A1 | 3/2014 | Schneider et al. | |
| 2014/0110983 | A1 | 4/2014 | Sander et al. | |
| 2014/0152064 | A1 | 6/2014 | Sander et al. | |
| 2014/0183915 | A1 | 7/2014 | Deisig et al. | |
| 2016/0135603 | A1* | 5/2016 | Chan | A47C 7/36<br>297/285 X |

* cited by examiner

RECLINE ADJUSTMENT SYSTEM FOR CHAIR

TECHNICAL FIELD

Various embodiments relate to task chairs and more specifically a tension system for resisting a rearward recline of a seat and back rest assembly.

Modern task and office chairs often include complex adjustment mechanisms designed to enable a user to adjust support provided by a chair to an occupant. For instance, many chairs include mechanisms for adjusting seat height, chair arm height, seat depth, seat incline, lumbar support, backrest angle, the force required to recline a backrest, etc. In many cases these assemblies that are required to facilitate a desired functionality are relatively complex including many interacting components and therefore are relatively expensive. Further, most inexpensive chair configurations do not include adjustable support assemblies due to the relative expense thereof.

Thus, there is a need in the seating industry to reduce the costs associated with adjustable support assemblies so that chair adjustment functionality can be included in relatively inexpensive chair structures.

BRIEF SUMMARY

In one embodiment, a seating arrangement includes a base support, a support arrangement configured to support a seated user and moveable between an upright position and a reclined position, and a spring arrangement positioned between the base support and the support arrangement. The spring arrangement includes a first portion attached to the support arrangement, a second portion attached to the base support, an intermediate portion positioned between the first portion and the second portion, a first spring member configured to bias the support arrangement from the reclined position toward the upright position, a second spring member configured to bias the support arrangement from the reclined position toward the upright position, the second spring member spaced from the first spring member, and an adjustment member positioned between the first portion and the intermediate portion, wherein the adjustment member is adjustable between a first position where the first spring member exerts a first force on the first portion and the second spring exerts a second force on the intermediate portion, and a second position where the first spring member exerts a third force on the first portion that is different than the first force and the second spring exerts a fourth force on the intermediate portion that is different than the second force.

In another embodiment, a seating arrangement includes a base support, a support arrangement configured to support a seated user and moveable between an upright position and a reclined position, and a spring arrangement positioned between the base support and the support arrangement. The spring arrangement includes a first portion attached to the support arrangement, a second portion attached to the base support, a first spring member configured to bias the support arrangement from the reclined position toward the upright position, wherein the first portion and the second portion each include a substantially straight section that are substantially parallel with one another when the support arrangement is in the upright position, and wherein the first spring member includes a first U-shaped section extending between the first portion and the second portion, and an adjustment member positioned between the first portion and the second portion, wherein the adjustment member is adjustable between a first position where the first spring member exerts a first force on the first position, and a second position where the first spring member exerts a second force on the first portion that is different than the first force.

In various embodiments disclosed herein, it is recognized that a spring and coupler assembly can be used to provide an adjustable chair recline assembly using minimal and relatively inexpensive components so that recline features normally associated with relatively expensive chair assemblies may be provided in less expensive configurations. Further, the present inventive seating arrangement provides an uncomplicated design that may be easily and quickly assembled, is relatively inexpensive, is capable of a long operating life, and is particularly well adapted for the proposed use.

These and other features, advantages, and objects of the various embodiments disclosed herein will be further understood and appreciated by those skilled in the art by reference to the following specification, claims, and appended drawings.

DETAILED DESCRIPTION OF THE PREFERRED EMBODIMENTS

Figure 1:
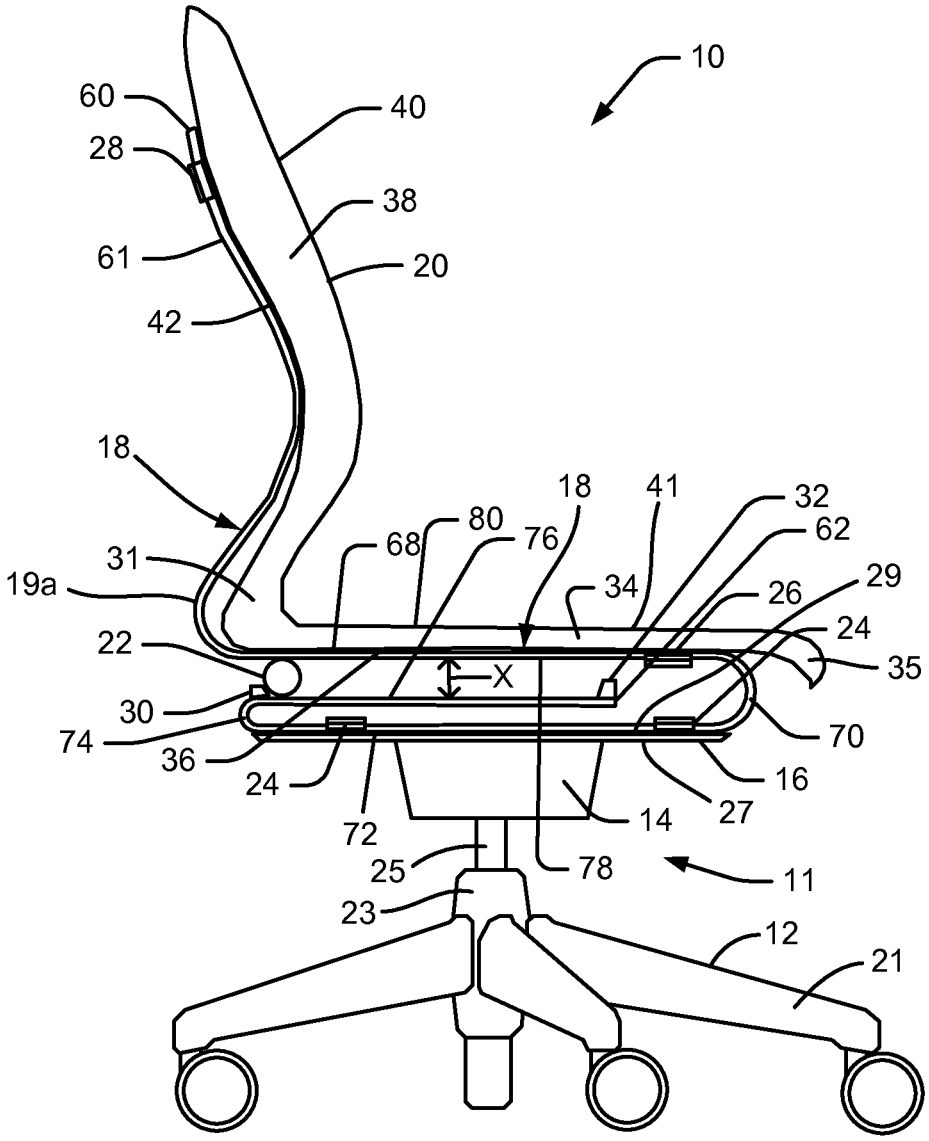
FIG. 1 is a side elevational view of an embodiment of a seating arrangement.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise. Further, the term seating unit or seating arrangement as utilized herein encompasses various seating arrangements of office chairs, vehicle seating, home seating, stadium seating, theater seating, and the like.

Figure 2:
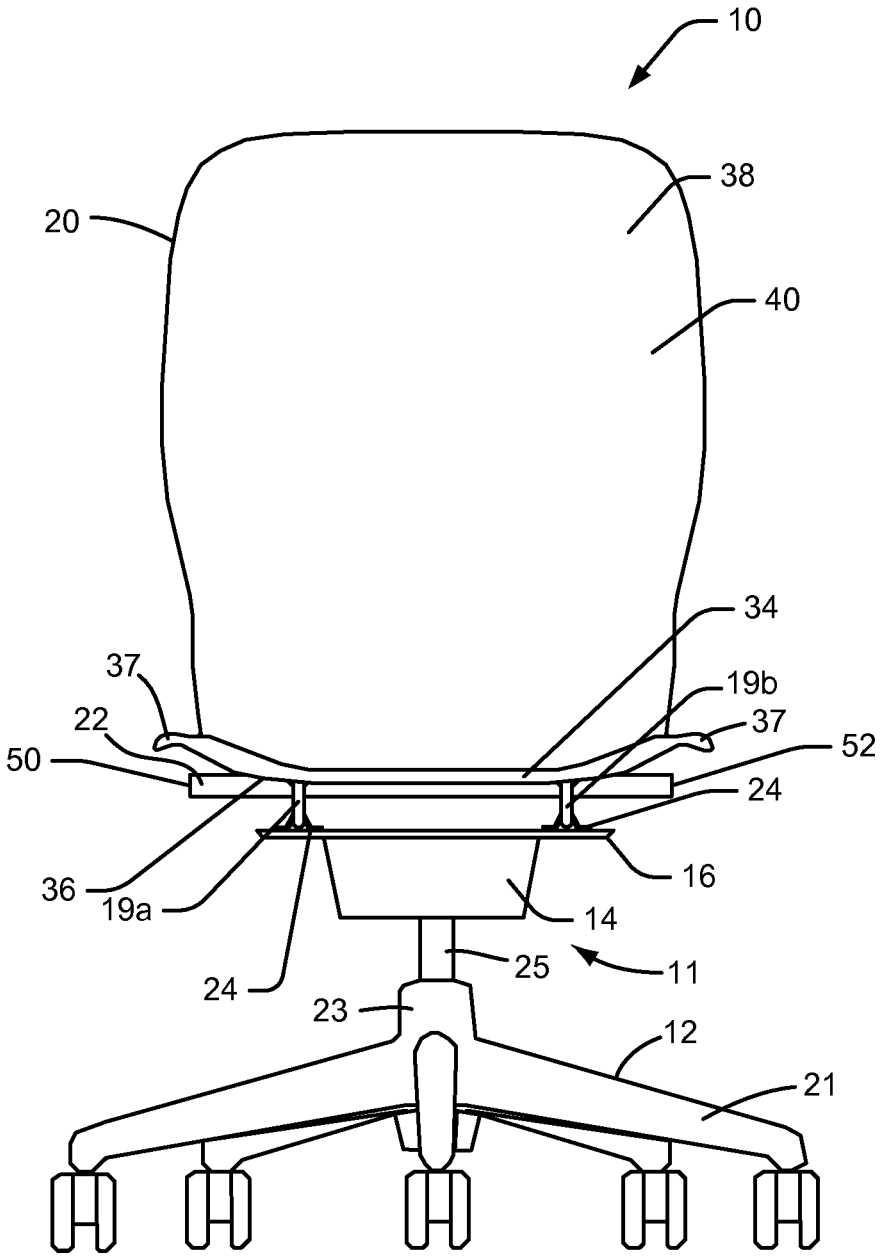
FIG. 2 is a front elevational view of the embodiment of the seating arrangement shown in FIG. 1.

The reference numeral 10 (FIGS. 1-3) generally designates an embodiment of a seating arrangement. In the illustrated example, the seating arrangement 10 includes a base subassembly or base support 11, a biasing assembly or spring subassembly 18 and a seat shell 20. The biasing assembly 18 includes a first spring arrangement 19*a* and a second spring arrangement 19*b*, and a coupler or adjustment member 22. The base subassembly 11 includes a lower base support 12, an upper pedestal 14 and a plate member 16. The lower base support 12 includes a conventional star pattern base configuration including five leg members 21 that extend in a star pattern from a central hub member 23 when viewed from above. A post member 25 is mounted centrally in the hub member 23 for rotation about a vertical axis. The pedestal structure 14 is mounted at the top end of the post member 25 for rotation therewith. The plate member 16 comprises a flat rigid rectangular or square plate that includes a bottom surface 27 mounted to the top of the pedestal member 14 and a top surface 29 that faces upward and is substantially horizontal. The top surface 29 of plate member 16 forms a first bearing surface.

The seat shell 20 may comprise a single molded plastic member that is formed into the shape of a combined seat support structure 34 and backrest support structure 38. In at least some embodiments described herein, the seat support structure 34 and the backrest support structure 38 of the seat shell 20 may be flexibly resilient and formed to provide different stiffness and flexibility characteristics. For instance, an intermediate portion 31 of the seat shell 20 between the seat support structure 34 and backrest support structure 38 may have a reduced overall thickness such that the intermediate portion 31 of the seat shell 20 may be more flexible than other portions of the seat shell 20. Similarly, a front portion 35 and lateral portions 37 of the seat support structure 34 may be thinner to be more flexible to accommodate the rear portions of a person's legs comfortably when sitting in the seating arrangement 10. The seat support structure 34 includes a downwardly disposed bottom surface 36 and an upwardly disposed top surface or support structure 41. The backrest support structure 38 includes a front support surface 40 and an oppositely facing rear surface 42. The bottom surface 36 forms a second bearing surface that is spaced apart and above the first bearing surface formed by the top surface 29 of the plate member 16. The seat shell 20 may be covered with a fabric cover (not shown) in whole or in part and/or covered with a cushion and fabric subassembly. Alternatively, the seat shell 20 may be replaced by a mesh fabric (not shown) stretched across one or more frame structures (not shown) to provide user supporting surfaces or a combination of mesh, frames, shell, fabric and cushion. Further, arm support subassemblies (not shown) may be mounted to the pedestal member 14 or other chair structure to provide user arm support.

Figure 3:
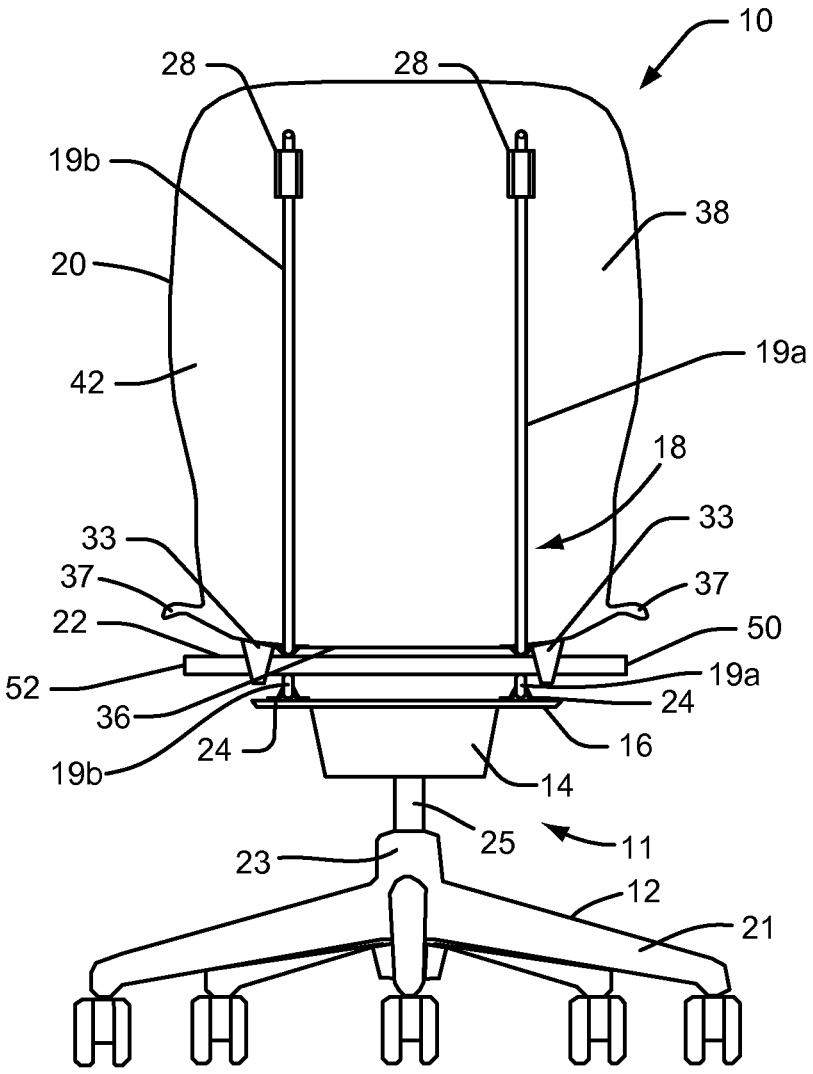
FIG. 3 is a rear elevational view of the embodiment of the seating arrangement shown in FIG. 1.
Figure 4:
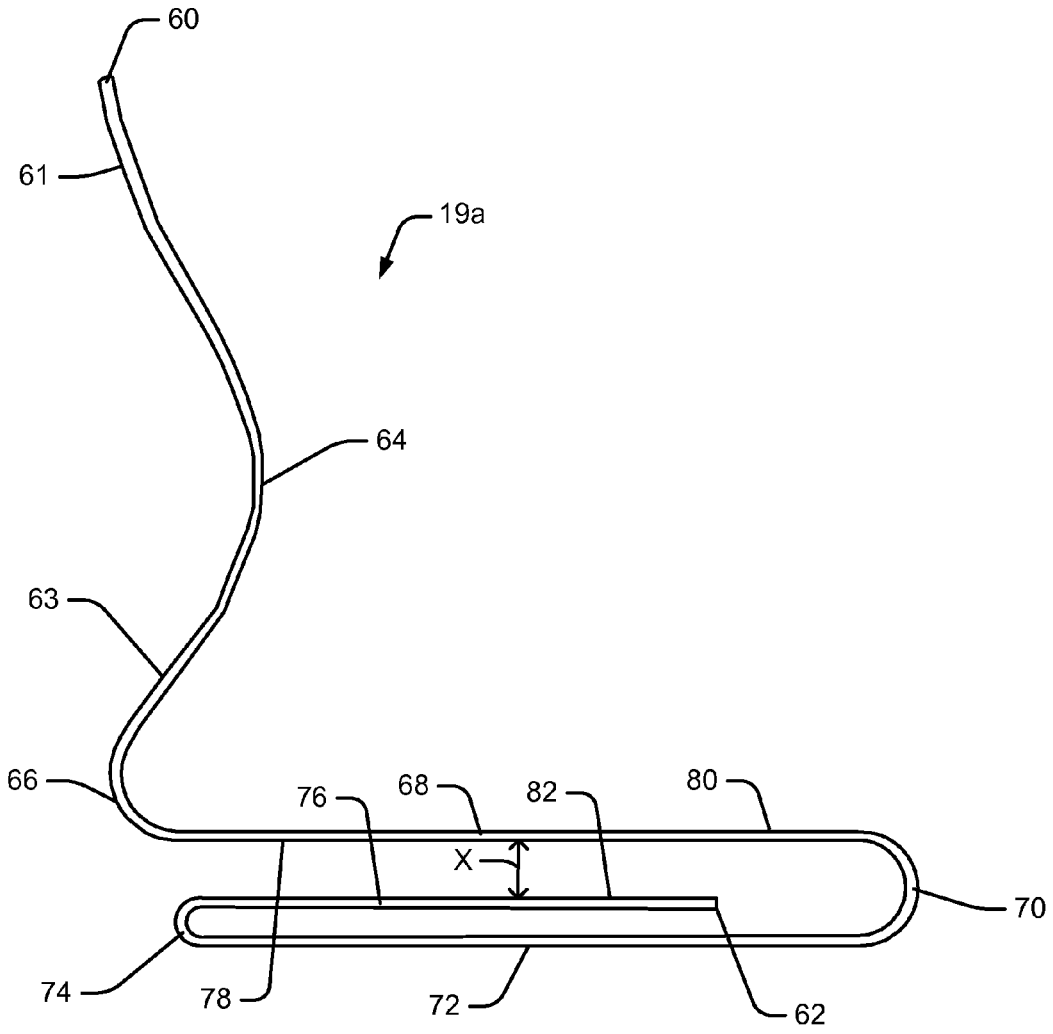
FIG. 4 is a side elevational view of the embodiment of the spring arrangement shown in FIG. 1.

The spring arrangements 19*a*, 19*b* (FIG. 4) are similar in construction and configuration. As the spring arrangement 19*b* is similar in configuration and construction to the spring arrangement 19*a*, the description of the spring arrangement 19*a* is exemplary of both of the spring arrangements 19*a*, 19*b*. In the illustrated example, the spring structure 19*a* comprises an elongated rod formed so as to generally define or follow the contours of the seat shell 20, including the seat support structure 34 and the backrest support structure 38 thereof. The spring structure 19*a* may comprise steel or other material suitable for such applications, such as carbon fiber. The spring arrangement 19*a* as shown in FIG. 4 is a non-stressed steady state condition generally conforming to an upright position of the seat arrangement 10 as described further below. In at least some embodiments the spring arrangement 19*a* may have a generally circular cross section of substantially uniform dimensions along its entire length. In other embodiments the spring arrangement 19*a* may have an oval cross section, a rectangular cross section or some other shaped cross section. In some embodiments the cross section of the spring arrangement 19*a* may vary along the length thereof. For example, the spring arrangement 19*a* may have a cross section with a first set of characteristics (e.g., relatively thinner, oval, etc.) in the areas that are intended to bend or flex, and may have a cross section having a second set of characteristics (e.g., relatively thicker, rectangular, etc.) in the areas that are intended to remain straight or rigid. In certain embodiments, the spring arrangement 19*a* may have three or more different cross sections at different locations along the length thereof depending on desired operating characteristics of the different sections. As best illustrated in FIG. 3, the spring arrangements 19*a*, 19*b* may each be configured to reside within a single vertical plane.

As illustrated, the spring arrangement 19*a* includes a first end 60 and a second end 62. The spring arrangement 19*a* further includes an upper back portion 61, a lumbar portion 64, a lower back portion 63, an intermediate bend portion 66, a seat supporting portion or first portion 68, a knee bend portion or first spring member 70, a plate mounting portion or second portion 72, a lower bend portion or second spring member 74 and an intermediate portion 76. The upper back portion 61 is slightly curved to be concave in the forward direction, while the lumbar portion 64 is curved to be convex in the forward direction, and the lower back portion 63 is generally straight along the length thereof or may have a slight curve that continues the concave forward shape of lumbar portion 64. The intermediate bend portion 66 has a generally forward concave shape such that the ends of the intermediate bend portion 66 extend to form an angle of preferably between 50° and about 90° therebetween, and more preferably an angle of about 60° to about 70°, with one end of the intermediate bend portion 66 being substantially horizontally oriented and the other end extending generally vertically upward.

The first portion 68 of the spring arrangement 19*a* may include a substantially rigid straight member that forms a top surface 80 and an undersurface 78, and that extends in a forward direction from the intermediate bend portion 66 toward the first spring member 70. The first spring member 70 is U-shaped and forms a substantially 180° (within plus or minus 10°) bend that is convex in the forward direction. The second portion 72 may include a substantially rigid straight member that is substantially parallel to the first portion 68 when the spring is unstressed (i.e., when the seat assembly 10 is in an upright position). The second portion 72 extends substantially along the entire length of the first portion 68 and, in some cases, is slightly shorter than the first portion 68. The second spring member 74 is U-shaped and forms a substantially 180° (within plus or minus 10°) bend that is concave in the forward direction. The intermediate portion 76 may include a substantially straight and rigid member that extends from the second spring member 74 to the second end 62 and is substantially parallel to the first portion 68 and the second portion 72 when the spring structure 19*a* is unstressed. The intermediate portion 76 includes a top surface 82 that is spaced from the bottom surface 78 of first portion 68 by a distance X when the spring arrangement 19*a* is unstressed.

Although not shown, in at least some embodiments the top surface 82 and bottom surface 78 may be non-parallel when the spring structure 19*a* is in an unstressed state such that the surfaces 82, 78 converge slightly when moving along the first portion 68 in the rearward direction. In this example, the first portion 68 and the intermediate portion 76 would be spaced the distance X at the greatest distance of separation along the length of the first portion 68.

In at least some particularly advantageous embodiments the dimensions and other mechanical properties of spring sections or members are as follows. The upper back portion 61 may have a length dimension between 6 and 12 inches, the lumbar portion 64 may have a length between 5 and 9 inches, while the lower back portion 63 may have a length between 3 and 8 inches. The intermediate bend portion 66 may have a length between 6 and 12 inches and bends radially to form a radius of between 1½ inches and 3 inches. The first portion 68 may have a length dimension between 10 and 17 inches, while the second portion 72 may have a similar length dimension between 8 and 15 inches. The radius of curvature about which the first spring member 70 is formed is preferably between 1 and 4 inches, and more preferably between 2 and 3 inches, while the radius of curvature about which the second spring member 74 is formed is preferably between ½ inch and 2 inches, and more preferably between 1 inch and 1½ inches. The distance X is preferably between ½ inch and 3 inches, and more preferably is between 1 inch and 2 inches when the spring arrangement 19*a* is unstressed. In the illustrated example, the first spring member 70 and the second spring member 74 each operate as a hinge allowing the first portion 68 to pivot generally about a horizontal axis when suitable force is applied.

The adjustment member 22 (FIGS. 1-3) includes a rigid and straight rod or the like that has a diameter or width dimension slightly greater than the distance X. For instance, where the distance X is 1¼ inches, the rod diameter or width dimension may be ⅛ to ¼ inch greater than 1¼ inches such that when adjustment member 22 is placed between the bottom surface 78 and the top surface 82, the first portion 68 and the intermediate portion 76 are forced slightly apart and friction therefrom tends to hold the adjustment member 22 in place unless moved or repositioned by a seat user. The adjustment member 22 preferably has a length dimension between 8 inches and 25 inches in at least some embodiments. The adjustment member 22 comprises steel or other material suitable for such applications.

In assembly, the spring arrangements 19*a*, 19*b* (FIGS. 1-3) are mounted to the top surface 29 of the plate member 16 via a plurality of mounting brackets 24 subsequent to assembly of the base support 11. In the illustrated example, the spring arrangements 19*a*, 19*b* are mounted to the plate member 16 such that each of the spring arrangements 19*a*, 19*b* each reside in a single vertical plane. The brackets 24 are metal brackets that are fastened across member 72 and are mechanically secured to the plate member 16 via screws, bolts and nuts, rivets, or some other type of fastening mechanism. In some cases a plastic, rubber or other type of bushing may be provided between each bracket 24 and the spring arrangements 19*a*, 19*b* to minimize any noise in the event that components rub against each other during seat adjustment or use. Preferably, the spring arrangements 19*a*, 19*b* are separated from each other by a space of between about 6 inches and 19 inches, and more preferably between 8 and 12 inches.

The seat shell 20 is mounted to the spring arrangements 19*a*, 19*b* via brackets 26 and 28. As illustrated, brackets 26 secure the bottom surface 36 of the seat support structure 34 to the top surface 80 of the first portion 68 of each of the spring arrangements 19*a*, 19*b* proximate the first spring member 70, while the brackets 28 secure the rear surface 42 of the backrest support structure 38 to the forward facing surfaces of upper back portion 61 of each of the spring arrangements 19*a*, 19*b*. The surfaces of spring arrangements 19*a*, 19*b* proximate the undersurfaces 36 and the rear surface 42 of the seat shell 20 contact the seat shell 20 and provide support thereto in at least some embodiments. The adjustment member 22 is positioned between the bottom surface 78 and the top surface 82 of the spring arrangements 19*a*, 19*b* such that the surfaces 78, 82 abut the adjustment member 22.

Figure 5:
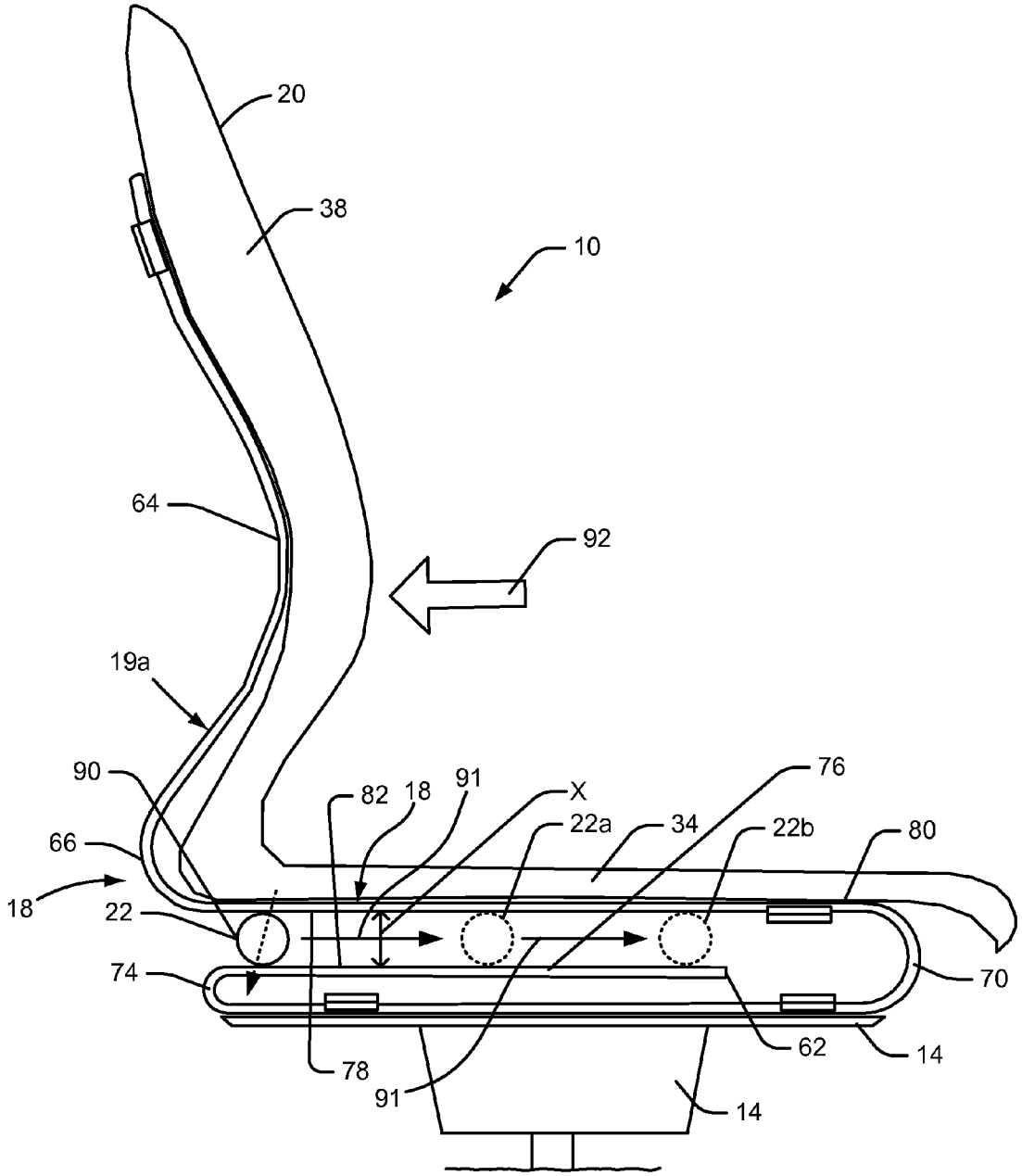
FIG. 5 is a partial side elevational view of the seating arrangement shown in FIG. 1, wherein an adjustment member is shown in a plurality of positions, and the seating arrangement shown in a fully upright position.

In operation, the adjustment member 22 may be moved along the length of the intermediate portion 76 to adjust the force exerted on the seat shell by the biasing arrangement 18. For example, in FIG. 5 where the adjustment member 22 is positioned proximate the second spring member, the spring members 70, 74 bend relatively little when a person sits in the seating arrangement 10 and applies a rearward force as indicated at 92. More specifically, the applied force 92 is transmitted through the adjustment member 22 as indicated at 90 and through the first spring member 74 directly to the plate member 16, and the spring members 70, 74 of each of the spring arrangements 19*a*, 19*b* bend only minimally if at all such that the seat support structure 34 and the backrest support structure 38 remain in an upright position. It is noted that if a sufficient force 92 is applied to the backrest support structure 38, the intermediate bend portion 66 may bend at least partially to provide some backrest movement but substantial reclining will be impeded by the adjustment member 22. In this configuration, the adjustment member 22 is operably coupled to the bottom surface 36 via the first section 68 of the spring arrangements 19*a*, 19*b* while the intermediate bend portion 66 and the second spring member 74 are each operably coupled to the top surface 29 of plate member 16 through the second section 72.

Figure 6:
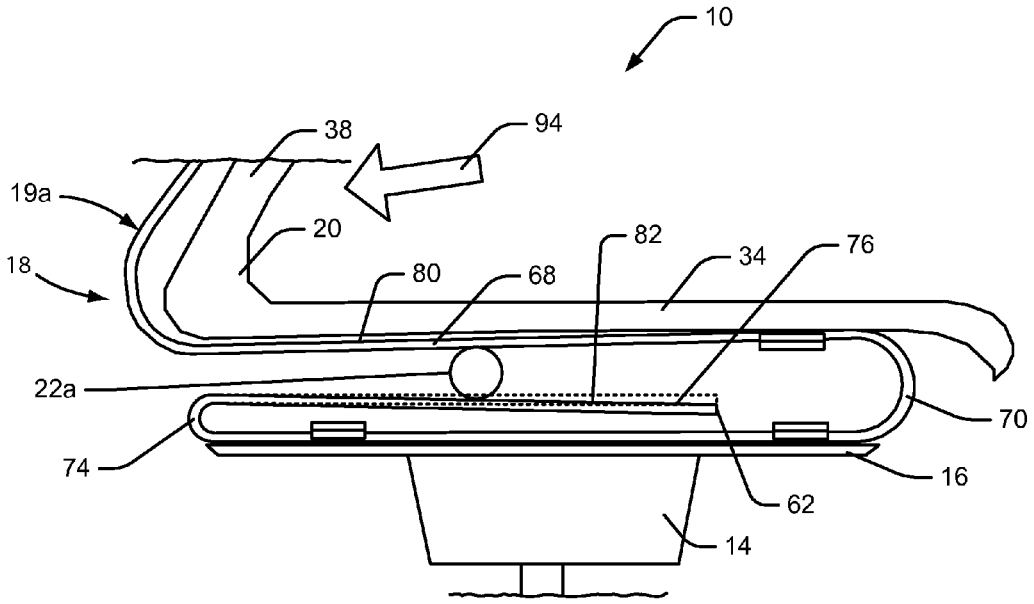
FIG. 6 is a partial side elevational view of the seating arrangement shown in FIG. 1 with the adjustment member shown in an intermediate position.

To adjust the force exerted on the seat shell 20 and increase the amount of allowed reclining action, one or both opposite ends of the adjustment member 22 can be grasped and slid in the forward direction 91 along the length of the intermediate portion 76 (e.g., see positions 22*a*, 22*b* (FIG. 5)). With the adjustment member 22 (FIG. 6) located in the position shown at 22*a*, the rearward force applied as indicated at 94 is applied to a central portion of intermediate section 76 which causes the spring ends 62 to deflect downward as the second spring member 74 of the spring arrangements 19*a*, 19*b* flex. In addition, the first spring member 70 of each spring arrangement 19*a*, 19*b* also flexes such that a rear end of each of the first portions 68 deflects downward. When the intermediate portion 76 and the first portion 68 each deflect downward, the seat support structure 34 and the seat shell 20 generally follow along with the top surfaces 80 of the first portions 68 such that the seat support structure 34 tips slightly rearward moving between the upright position and the reclined position, and the backrest support structure 38 tips rearward from the upright position to the reclined position.

Figure 7:
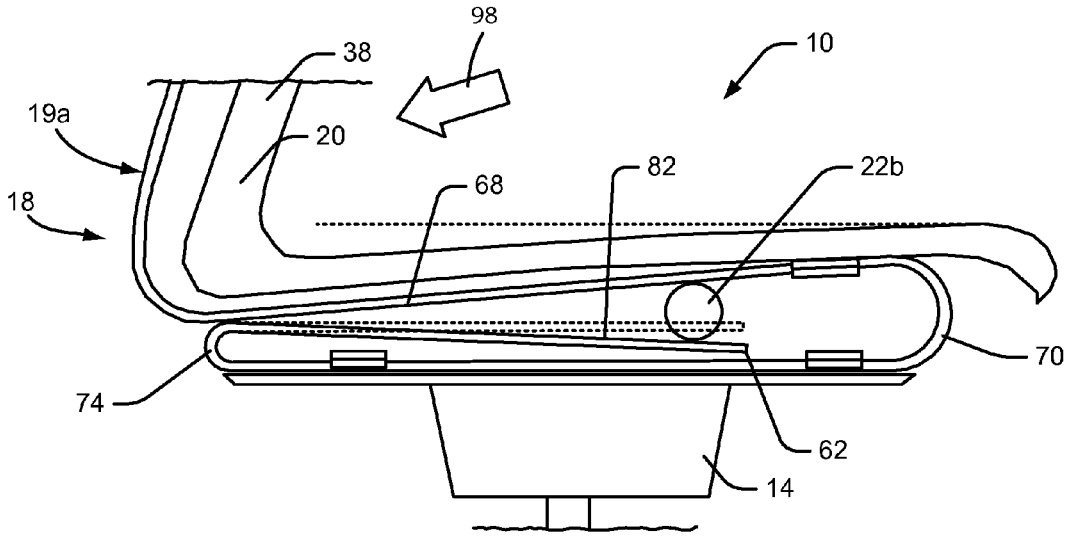
FIG. 7 is a partial side elevational view of the seating arrangement shown in FIG. 1 in a fully reclined position.
Figure 8:
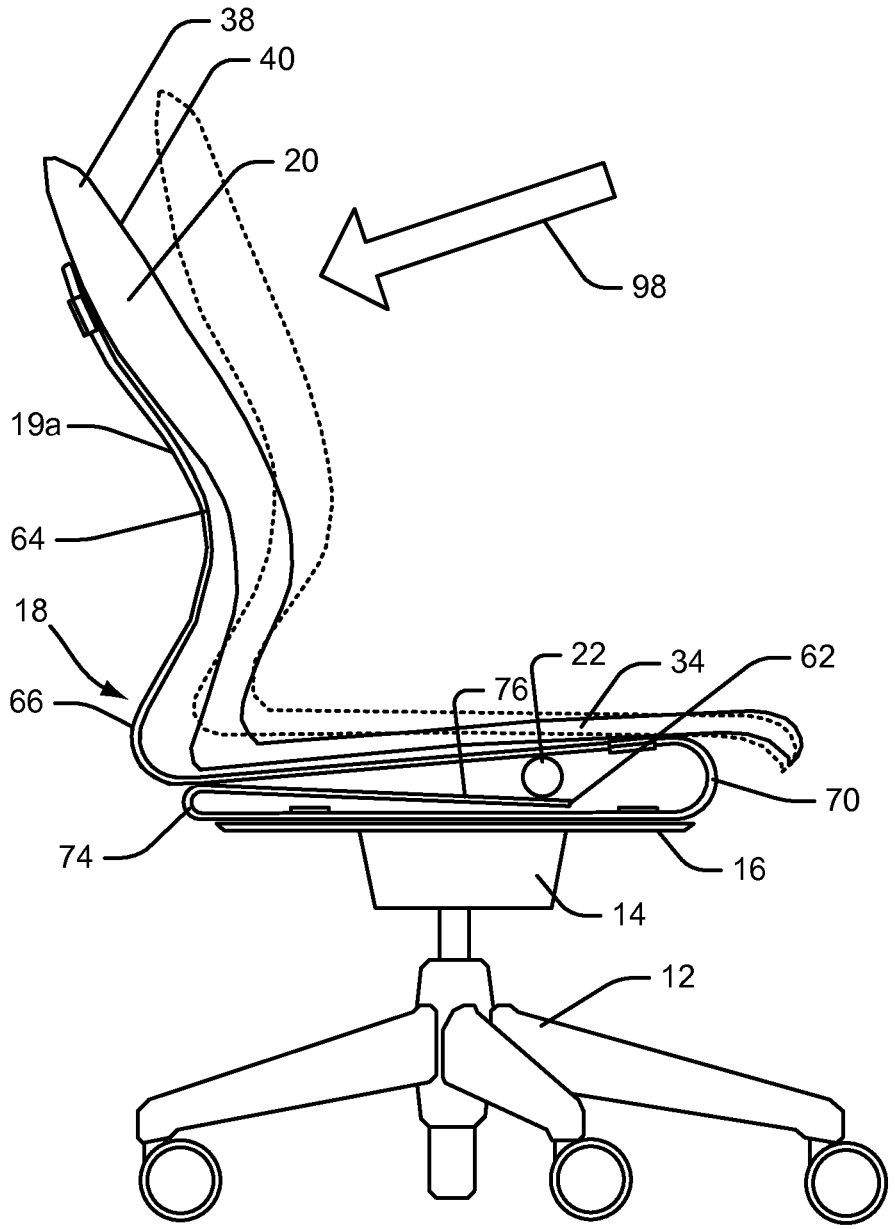
FIG. 8 is a side elevational view of the seating arrangement shown in FIG. 1 in the fully reclined position.

Referring to FIG. 7, with the adjustment member 22 in the position shown at 22*b* proximate the second ends 62 of the spring arrangements 19*a*, 19*b*, a rearward force as indicated at 98 (see also FIG. 8) is applied to a distal portion of the intermediate portion 76 which causes the spring ends 62 to deflect downward to an even greater degree as the spring arrangements 19*a*, 19*b* bend at the second spring member 74. In addition, each spring arrangement 19*a*, 19*b* also bends at the first spring member 70 such that a rear end of each first portion 68 deflects downward even more. When the intermediate portion 76 and the first portion 68 each deflect downward to the degree shown in FIG. 7, the seat support structure 34 and the seat shell 20 generally follow along with the top surfaces 80 of the first portions 68 such that the seat support structure 34 tips relatively substantially rearward to a fully reclined position, and the backrest support structure 38 tips substantially rearward to a maximum degree of recline. To this end, FIG. 8 illustrates the seat shell 20 in phantom lines in an upright position and in solid lines in a maximum reclined position. Although not shown in the figures, the seat shell 20 may flex somewhat during movement between the upright and reclined positions to accommodate the changes in spring configuration.

Figure 9:
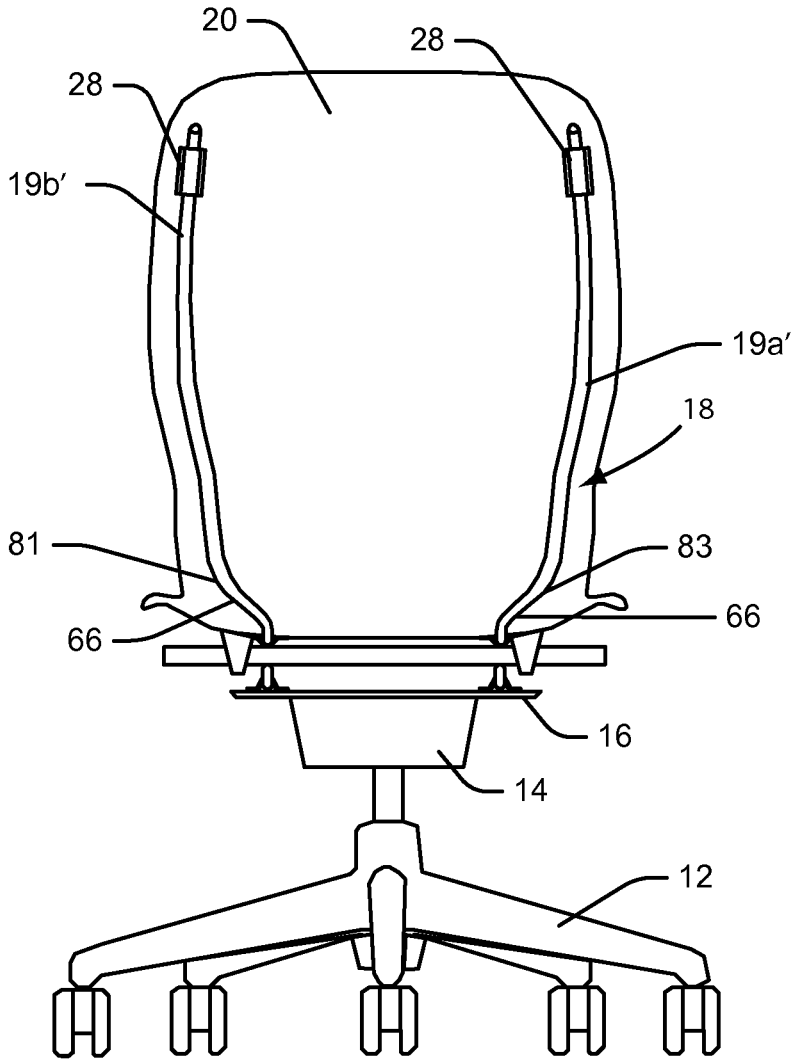
FIG. 9 is a rear elevational view of another embodiment of a seating arrangement.
Figure 10:
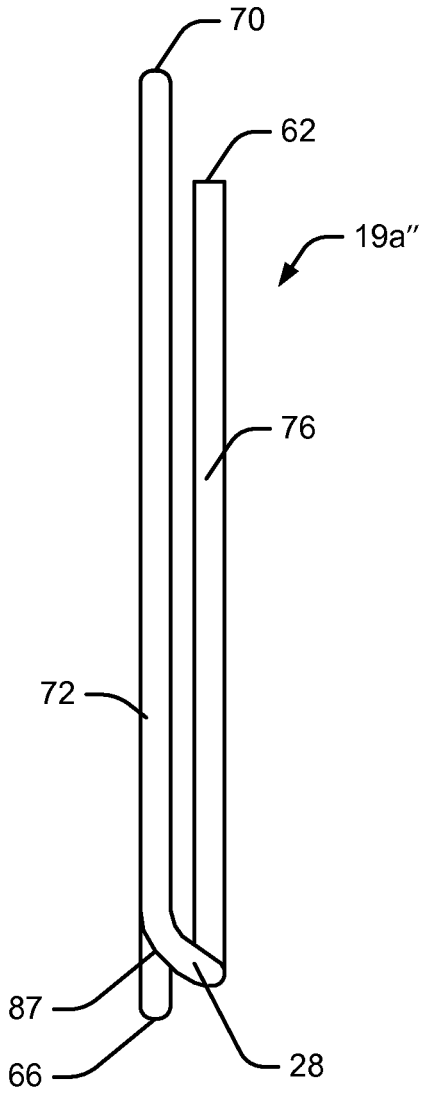
FIG. 10 is a bottom plan view of a spring arrangement of an alternative embodiment of a seating assembly.

While the spring arrangements 19*a*, 19*b* are described as each residing in a single vertical plane upon assembly of seating arrangement 10, in some embodiments it is contemplated that each spring may curve or bend into other planes. For example, and as best illustrated in FIG. 9, spring arrangements 19*a*' and 19*b*' are shown to curve outward at locations 81, 83 proximate the intermediate bend portions 66. In another alternative embodiment, a spring 19*a*" is shown in bottom plan view to have a laterally directed curve 87 proximate a rear end of member 70 such that member 76 is located in a second plane parallel to the plane in which other portions of spring 19*a*" reside. In this configuration, the intermediate bend portion 66 and the second spring portion 74 are in adjacent planes thereby providing additional clearance between the intermediate bend portion 66 and the second spring portion 74 such that the reclining range may be extended. Other spring shapes when viewed in a top, bottom or rear plan view are also contemplated.

In at least some embodiments there may be some additional structure or additional component features added to the seating arrangement described above to better define possible movements of the adjustment member 22. For instance, mechanical stops or range limiting members 30, 32 (FIG. 1) may be provided at the opposite ends of the intermediate portion 76 to limit the range of motion of the adjustment member 22 along the top surface 82 of the intermediate portion 76. In certain configurations, the stop members 30, 32 may be secured to the spring arrangements 19*a*, 19*b* themselves, such as illustrated in FIG. 1, while in other cases stop members or the like may be secured to other structure such as the seat shell 20 to extend the travel distance of the adjustment member 22 (e.g., the rear stops 33 in FIG. 3 that extend downward from an undersurface of the seat shell 20). In still other configurations, each spring arrangement 19*a*, 19*b* may form contours to provide stopping surfaces to limit the range of motion of adjustment member 22.

Figure 11:
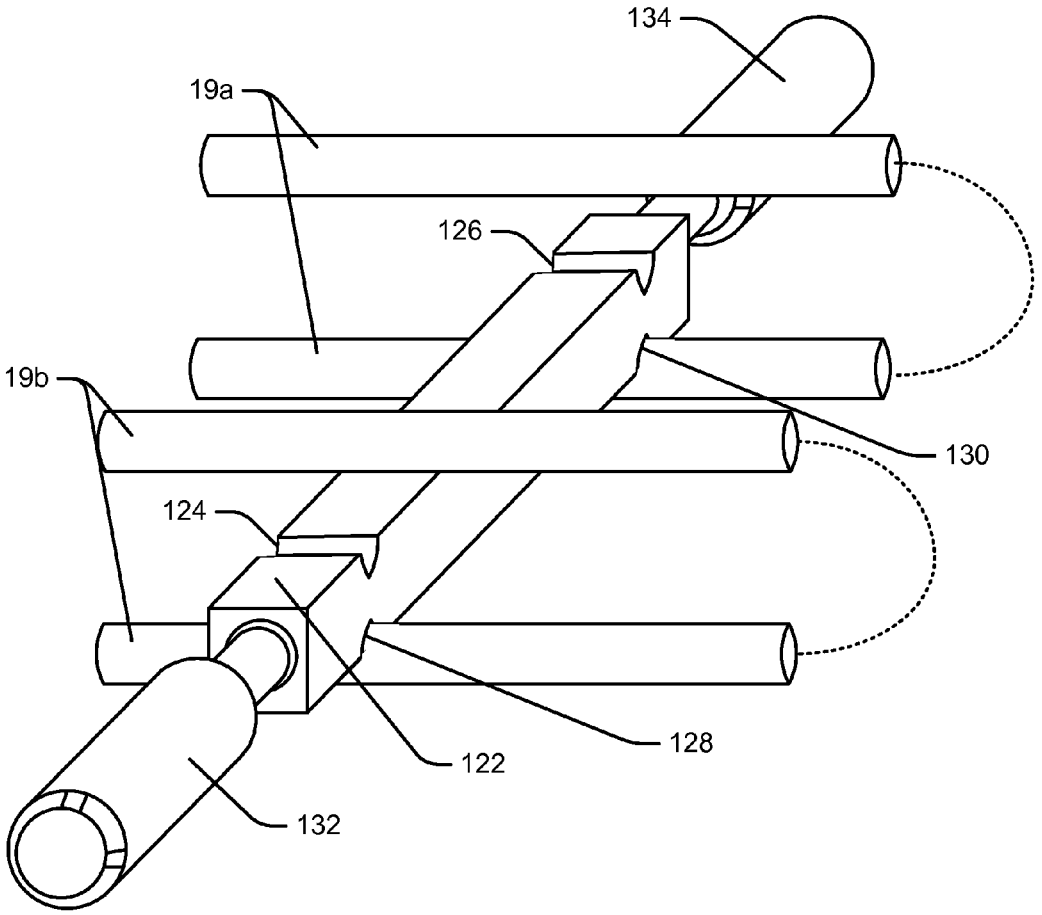
FIG. 11 is a partial schematic view of an alternative embodiment of an adjustment member.

Certain guidance features may also be provided to help maintain adjustment member 22 at least substantially perpendicular to the spring members that it contacts during movement. For example, an adjustment member 122 (FIG. 11) has a square cross section and includes a plurality of spring member receiving channels 124, 126, 128 and 130 in the top and bottom surfaces thereof. In the illustrated example, each channel 124, 126, 128 and 130 is configured to receive a spring arrangement 19*a*, 19*b* that can slide within the channel to adjust the position of the adjustment member 22. The channel surfaces and spring arrangements cooperate to maintain the perpendicular alignment of the adjustment member 122 and the spring arrangements 19*a*, 19*b*. Handles 132, 134 are provided on opposite ends of the adjustment member 122 and are configured to be grasped by a chair user to move the adjustment member 122 to different locations along the length of the intermediate portion 76.

Figure 12:
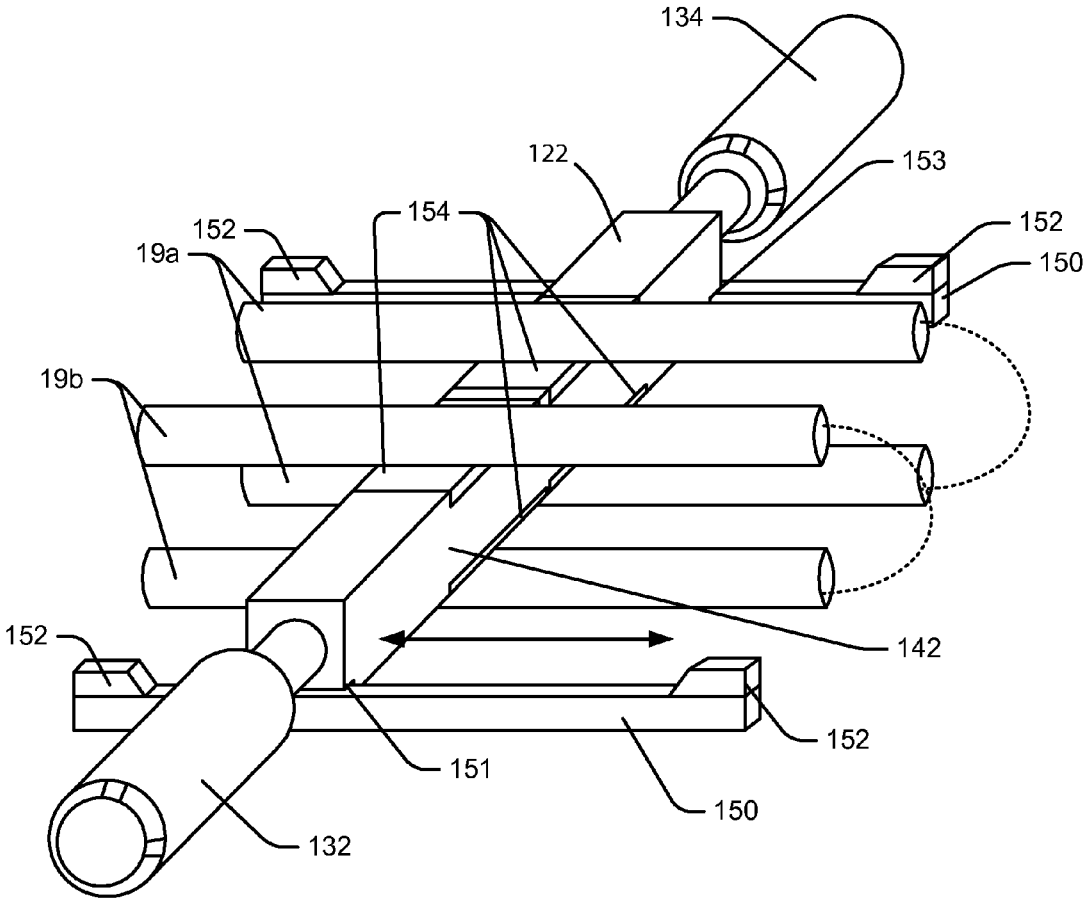
FIG. 12 is a partial schematic view of another alternative embodiment of an adjustment member.

In an alternative configuration, tracks 150 (FIG. 12) may be provided that interact with a coupler member 142 to guide the adjustment member 122 to different locations while maintaining the perpendicular alignment between the adjustment member 122 and the spring arrangements 19*a*, 19*b*. A pair of slots 151, 153 are formed on opposite ends of the coupler member 142 and the tracks 150 are mounted to a top surface of plate member 16 (FIG. 1). A pair of stops 152 are provided at opposite ends of the tracks 150 to limit the range of motion of the adjustment member 122. Further, slide plates or members 154 are secured to the coupler member 142 at locations that will contact the spring arrangements 19*a*, 19*b*. The slide plates 154 comprise a plastic or other low friction material such that the coupler member 142 may be moved along the spring arrangements 19*a*, 19*b* with minimal friction to adjust the recline range.

Figure 13:
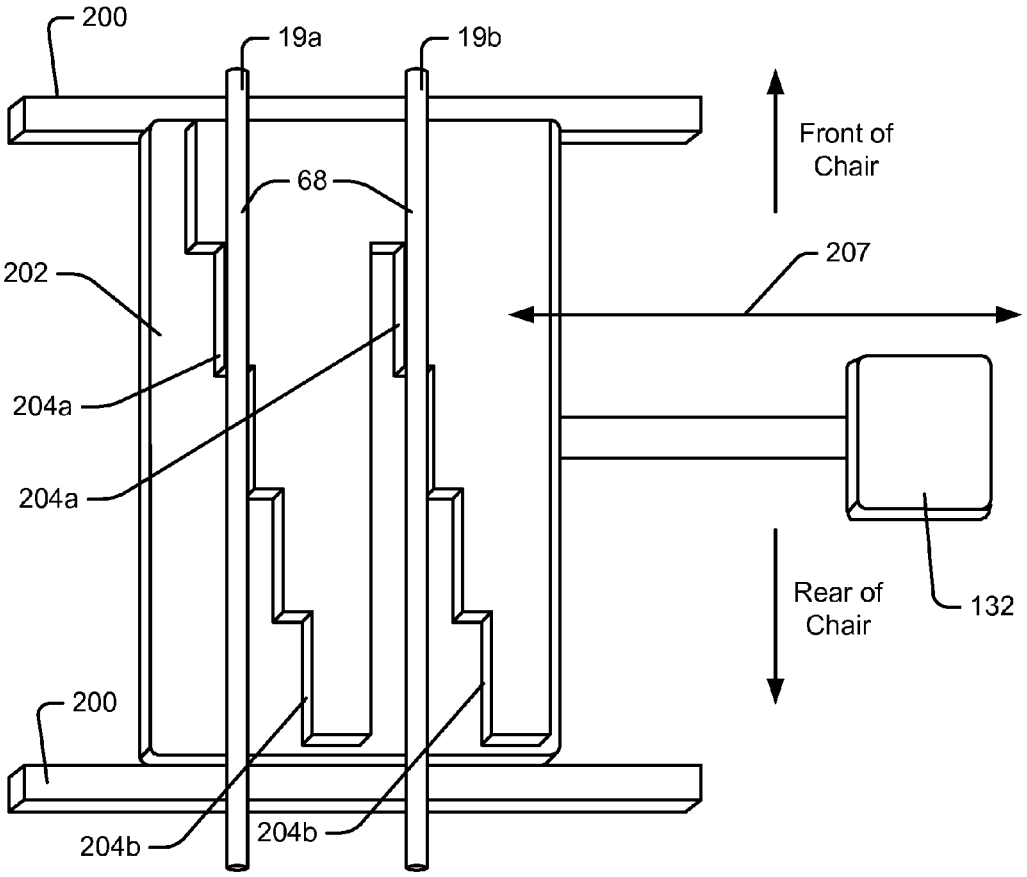
FIG. 13 is a schematic view of yet another alternative embodiment of an adjustment member shown in a first position.
Figure 14:
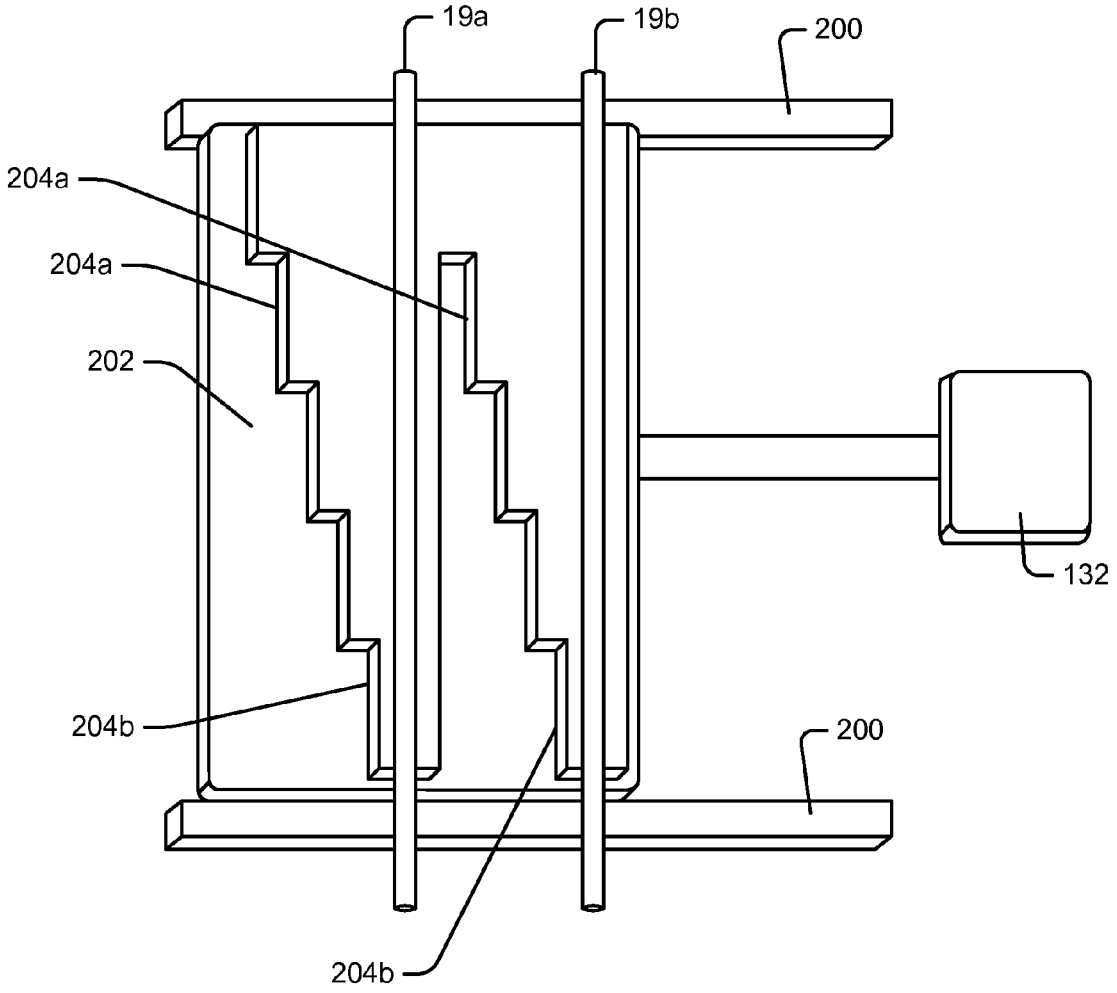
FIG. 14 is a schematic view of the adjustment member of FIG. 13 shown in a second position.

In still other embodiments, alternative configured adjustment members are contemplated. For instance, instead of having a rod-type coupler which moves along a trajectory that is parallel to the lengths of the first portions 76 (FIG. 1), a plate like coupler structure may be provided that moves perpendicular to first portions 76 to adjust the amount of force exerted by the biasing arrangement 18 upon recline. For example, an adjustment plate 202 (FIG. 13) includes pairs of stepped teeth 204*a*, 204*b*, etc., on a top surface. In this configuration, plate retaining tracks 200 are mounted to the mounting plate 16 or some other support structure below the first portions 68 to restrict motion of the adjustment plate 202 to a single trajectory 207 that is perpendicular to the first portions 68. The teeth 204*a*, 204*b*, etc., are aligned with the first portions 68 and the degree of recline allowed is a function of which the teeth 204*a*, 204*b*, etc. are aligned with the first portions 68. For example, the degree of recline would be greater where the first portions 68 are aligned with the teeth 204*a* (FIG. 13), than where the first portions 68 are aligned with the teeth 204*b* (FIG. 14). A handle 132 is provided for moving the adjustment plate 202 between different positions to control the degree of decline.

Figure 15:
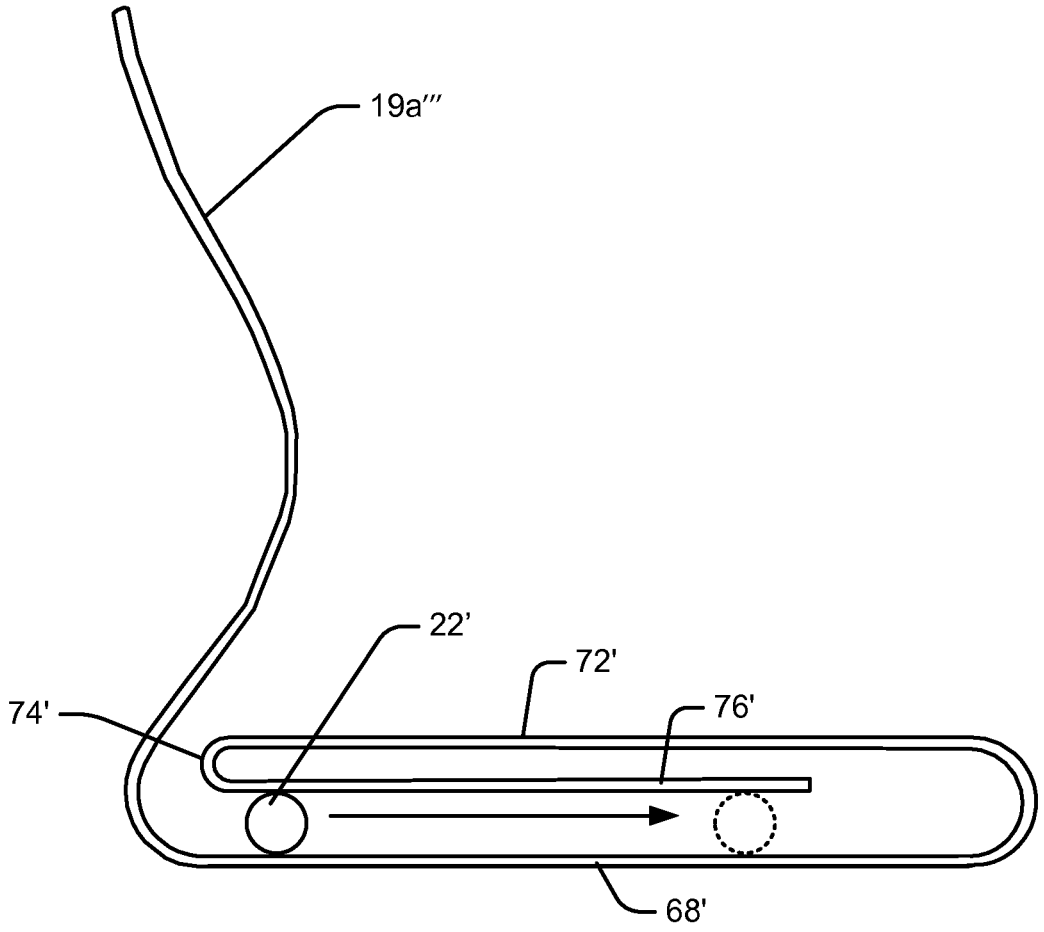
FIG. 15 is a side elevational view of an alternative embodiment of a spring arrangement.

Referring to FIG. 15, another spring arrangement 19*a*''' having a shape similar to the spring arrangement 19*a* shown in FIG. 4 is illustrated. In the instant example, the spring arrangement 19*a*''' includes sections below the seat support structure 34 (FIG. 1) of the seat shell 20 that are flipped over vertically reversed when compared to the spring arrangements shown in FIG. 1. In the configuration illustrated in FIG. 15, the second portion 72' is positioned above the first portion 68', while the second spring member 74' is positioned below the second portion 72'. The seat shell 20 (not shown in FIG. 15) is mounted to member 72' while the spring arrangement 19*a*''' is mounted to the mounting plate 16 (FIG. 1) via the first portion 68'. The adjustment member 22' is received between portions 68', 76' and recline range is adjusted by moving member 22' within along the length of the intermediate portions 76' in a fashion similar to that described above.

Figure 16:
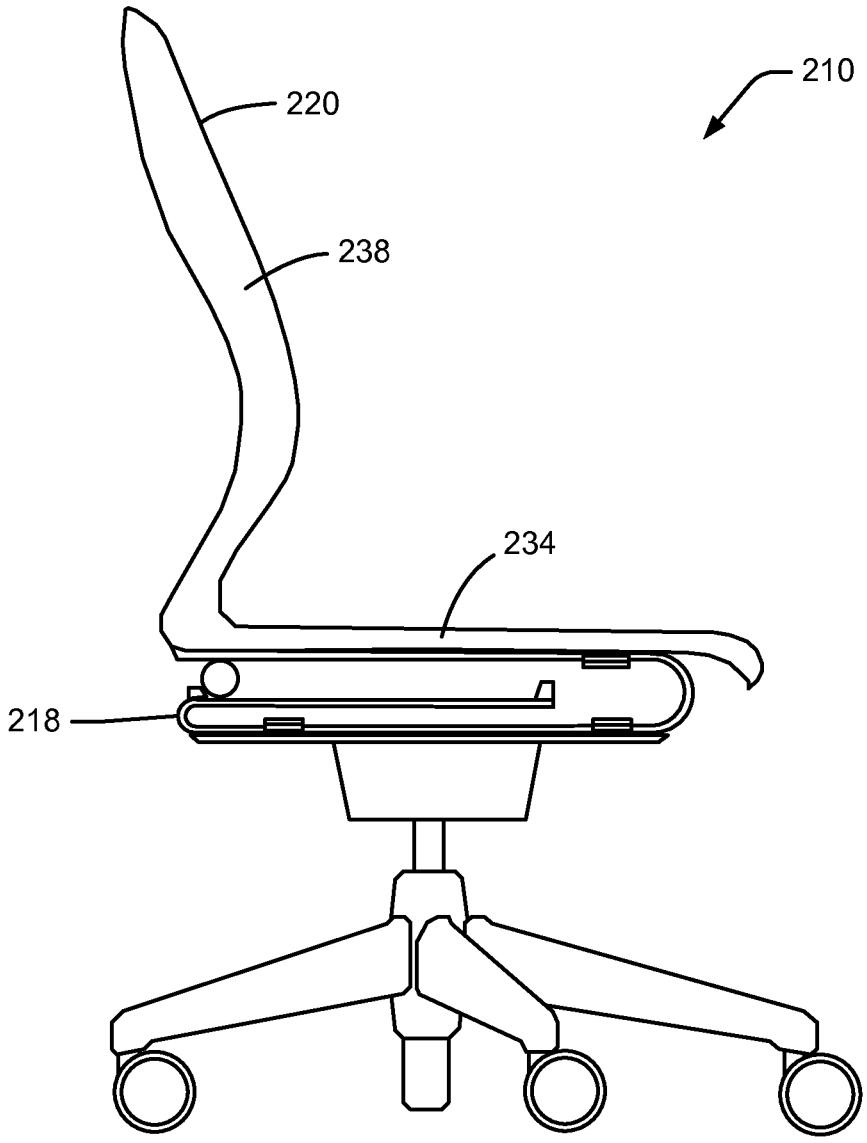
FIG. 16 is a side elevational view of the seating arrangement shown in FIG. 15 including stop members.

In certain configurations, seat shell 220 (FIG. 16) may be sufficiently resilient to support a chair user by itself, and the spring arrangements may not extend upward behind a chair backrest portion 238 of the seat shell 220 of the seating arrangement 210. In this configuration, the portions of the spring arrangements 218 position below a seat support structure 234 are similar to the portions shown and described above with respect to FIG. 1, with the most notable exception being that the spring arrangements 218 end near the bottom end of the backrest support structure 238 of the seat shell 20.

Figure 17:
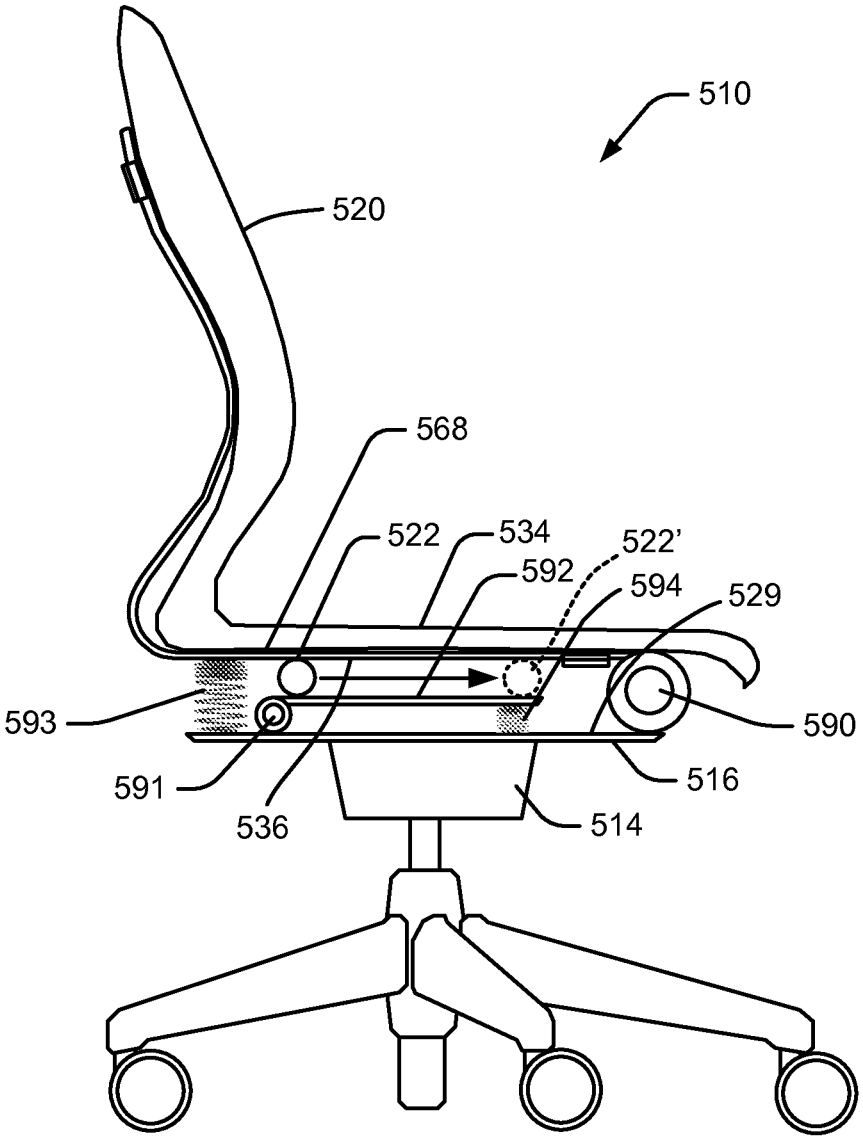
FIG. 17 is a side elevational view of an alternative embodiment of a seating arrangement.

Alternatively configured spring arrangements may also be utilized. For example, FIG. 17 illustrates a seating arrangement 510 that includes an arrangement of coil springs, pivots or hinges and plate members. More specifically, the seating arrangement 510 comprises a seat shell 520, and first pivots or hinges 590 and second pivots or hinges 591 mounted to the top surface 529 of the plate member 516. In this configuration, the hinge 590 is also connected to the undersurface 536 of the seat support structure 534 while hinge or pivot 591 is connected to an intermediate plate member 592. A first spring member in the form of a coil spring 593 is positioned between the plate member 516 and the first portion 538, while a second spring member 594 in the form of a coil spring is positioned between the plate 592 and the plate member 516.

The seating arrangement 510 operates in a fashion similar to the above-described seating arrangement 10 shown in FIG. 1. Specifically, the backrest recline range is substantially limited when adjustment member 522 is in a rearward position as shown in FIG. 17, and the backrest recline range is increased to the maximum level if the adjustment member 522 is moved to the forward position 522'.

Figure 18:
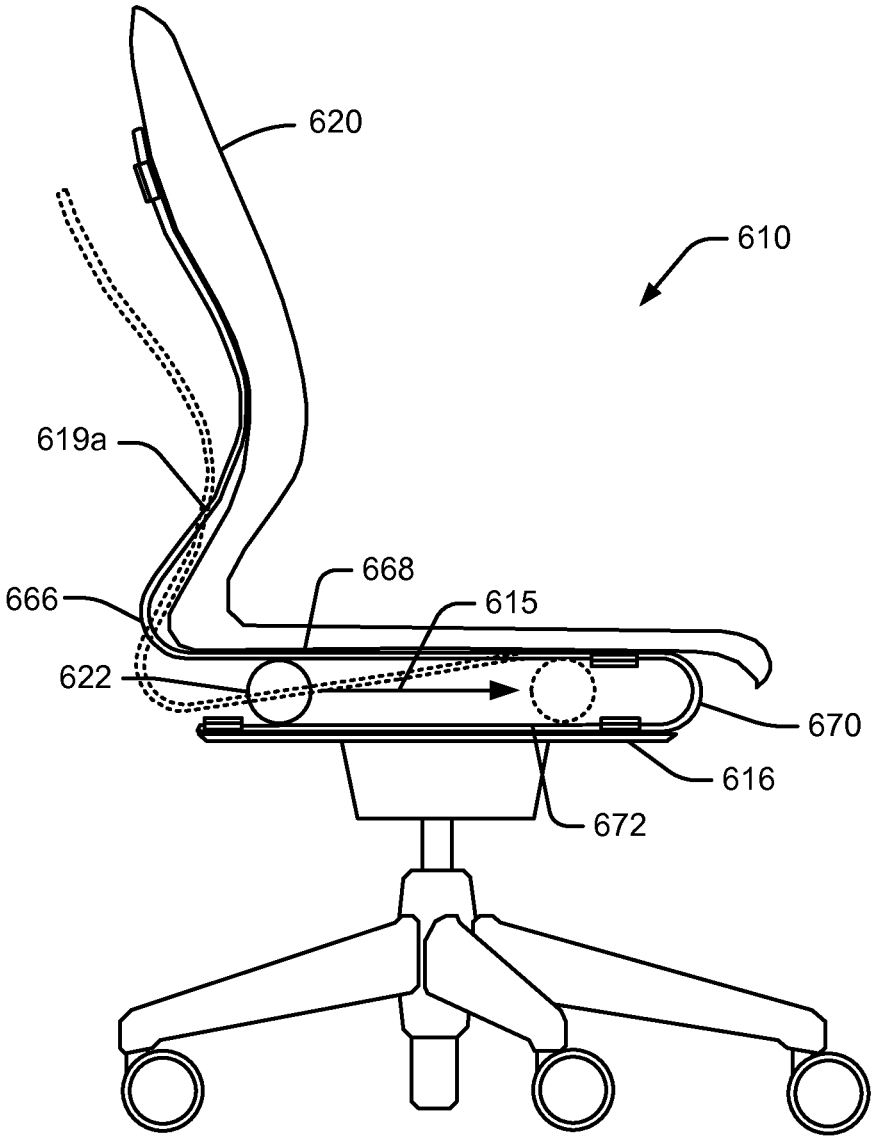
FIG. 18 is a side elevational view of another alternative embodiment of a seating arrangement.

In some embodiments an alternative spring arrangement illustrated in FIG. 18 may be utilized. In the illustrated example, a spring arrangement 619*a* is utilized within the seating arrangement 610. It is noted that the most significant difference between the spring arrangement 619*a* and the spring arrangements 19*a*, 19*b* of FIG. 1 is that the spring arrangement 619*a* does not include a second spring member in the form of a U-shaped bend, nor an intermediate portion. The second portion 672 is secured to the mounting plate 616 with the first spring member 670 located proximate the front end of the seating arrangement 610 and the seat shell 620 mounted to the first portion 668. The adjustment member 622 is positioned between the portions 668, 672 and slides therealong to direction 615 to adjust the degree of recline in a fashion similar to that described above with respect to FIG. 1. In the present configuration, the first portion 668 of the spring arrangement 619*a* is flexibly resilient along the length thereof such that the first portion 668 operates like a leaf spring to bend as shown in phantom in FIG. 18. It is noted that this differs from the previous embodiments where the first portions of the spring arrangements are relatively stiff (e.g., may have only minimal flexibility).

Figure 19:
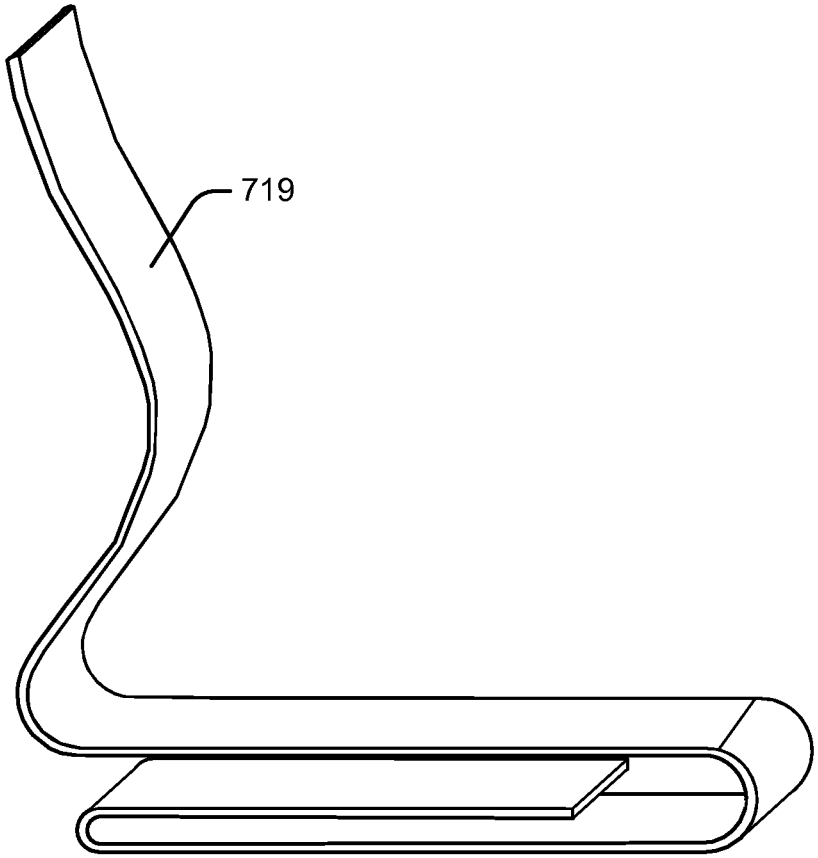
FIG. 19 is an elevational side view of yet another alternative embodiment of a spring arrangement.
Figure 20:
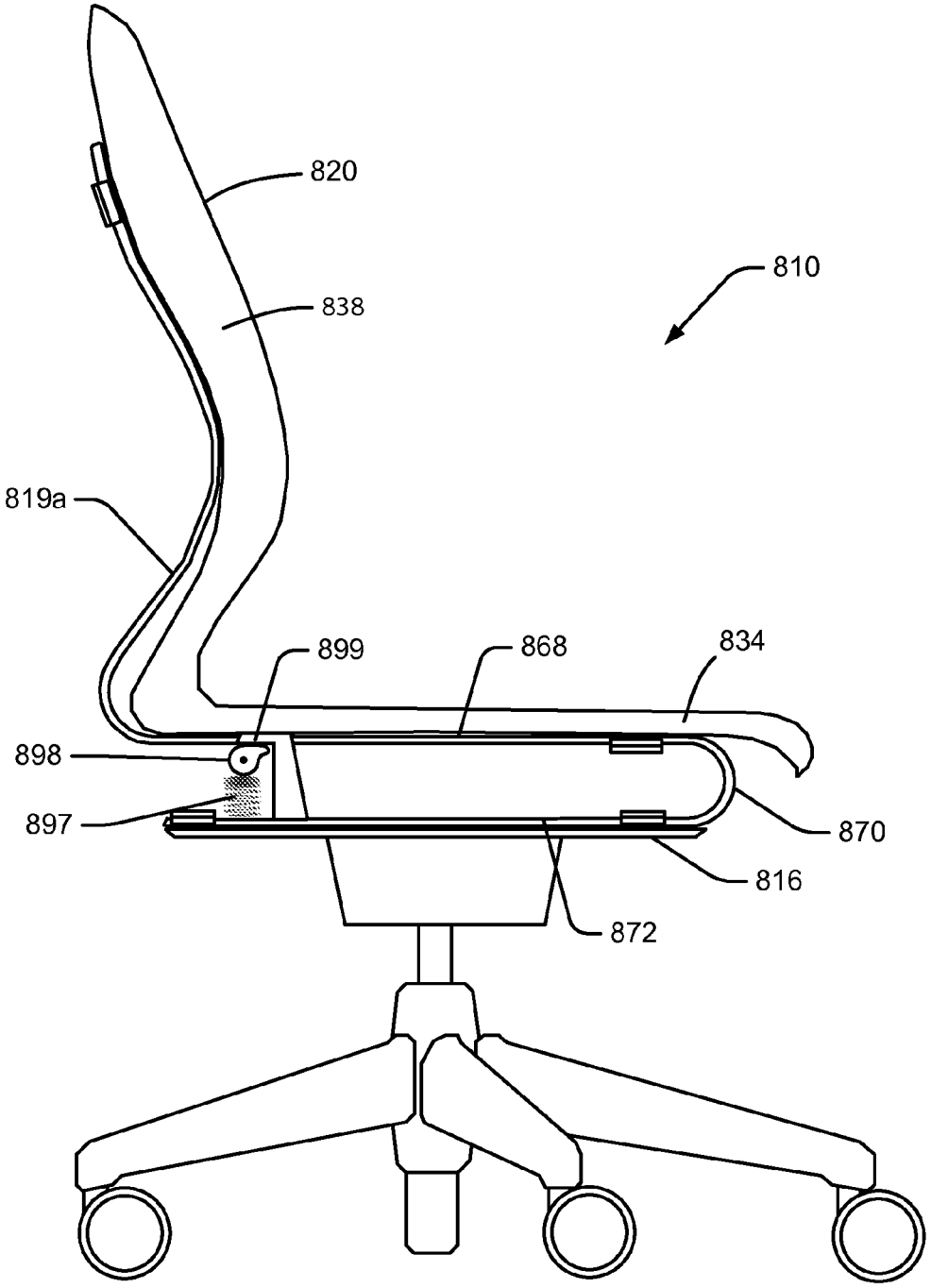
FIG. 20 is a side elevational view of yet another alternative embodiment of a seating arrangement, with a spring member shown in a cam member shown in a first position.
Figure 21:
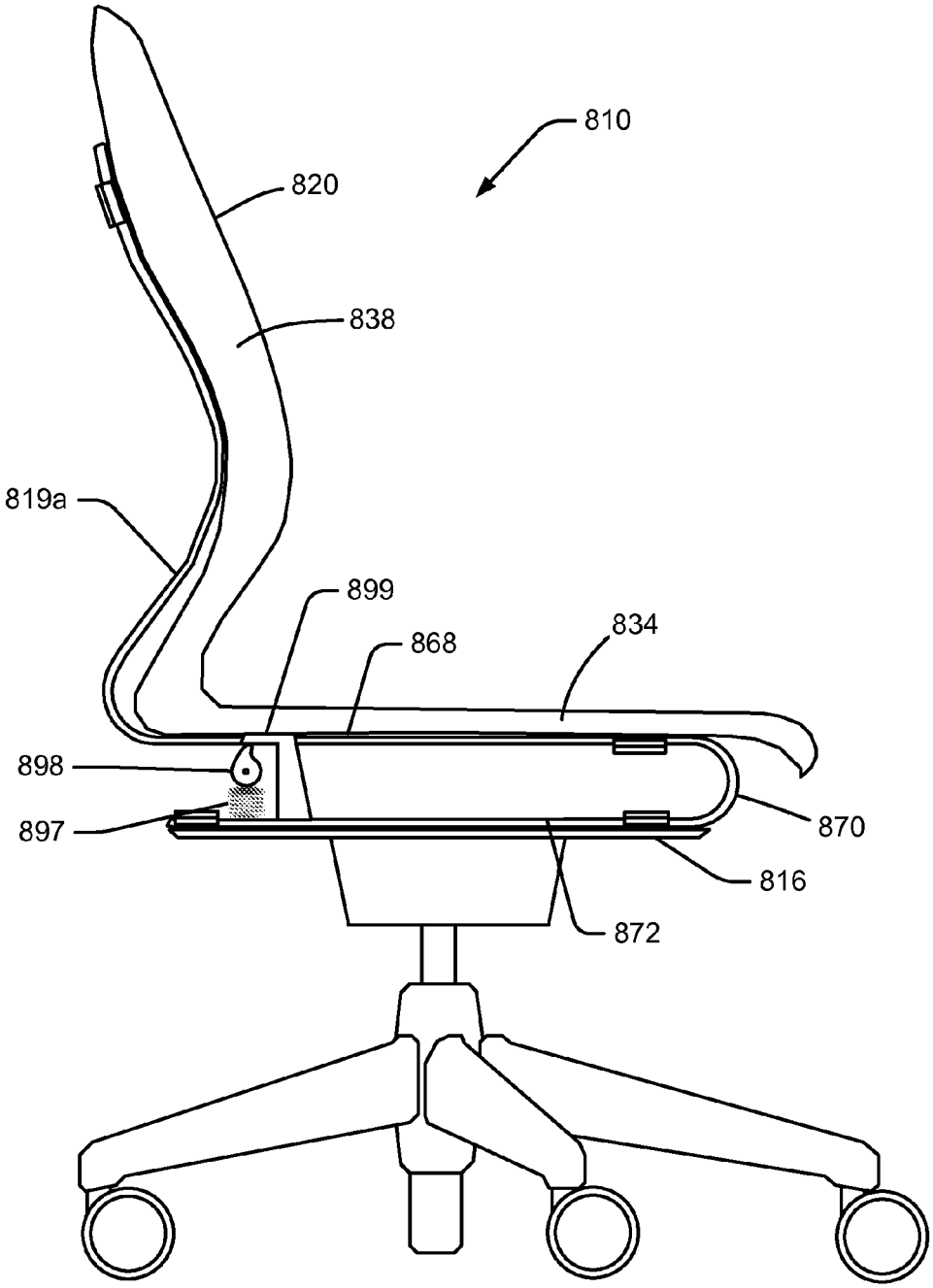
FIG. 21 is a side elevational view of the seating arrangement of FIG. 20, with the cam member shown in a second position.

While the seating arrangements described above incorporate dual springs or other structures for supporting an associated seat shell, other contemplated embodiments may include only a single spring or other adjustable structure. For example, a ribbon type spring arrangement 719 (FIG. 19) configured as a bent sheet may take the place of the two spring arrangements 19*a*, 19*b* (FIG. 1). In this embodiment, the spring arrangement 519 is provided a shape that is similar to the side elevation view shape of one of the spring arrangements 19*a*, 19*b*.

In yet another embodiment, the seating arrangement 810 includes a spring arrangement 819*a* configured similarly to the spring arrangement 619*a* shown in FIG. 18. The seating arrangement further includes a coil spring or second spring member 897 and a cam member 898 that adjust the force applied to the seat shell 820 and adjust the degree of recline possible. In the illustrated example, the first portion 868 and the second portion 872 are connected by the first spring member 870 such that the first portion 868 can pivot or rotate generally about the area near the first spring member 870 when a force is applied to the seat shell 820 which includes the seat support structure 834 and the backrest support structure 838. The second spring member 897 is operably coupled (e.g., directly contacts or is connected through some other component) to the top bearing surface of the plate member 816. The cam member 898 is mounted above a top end of second spring member 830 and can be adjusted to modify the extent to which the second spring member 897 is tensioned by exerting a pretension thereto. A stop member 899 is provided which interacts with a radial surface of the cam member 898 such that the tension in the second spring member 897 is adjusted while that the force applied to the undersurfaces of the first portion 868 remains constant. Thus, while the external surface of cam member 898 may contact the first portion 868 at all times, rotation of the cam member 632 to adjust the tension within the second spring member 897 does not increase or decrease the pressure applied to the first portion absent some force applied to the seat shell 820 to recline the same. It is contemplated that at one end of the range of rotation of cam member 898 the second spring member 897 may be substantially completely compressed such that the spring bottoms out. In situations where the second spring member 897 is completely compressed, seat shell 820 only reclines minimally through distortion of the portions of the spring arrangement 819 located behind the backrest support structure 838 of the seat shell 820.

While the invention may be susceptible to various modifications and alternative forms, specific embodiments have been shown by way of example in the drawings and have been described in detail herein. However, it should be understood that the invention is not intended to be limited to the particular forms disclosed. For example, while most of the embodiments described above include both a seat and a backrest supported by spring assemblies for adjustable recline, other embodiments are contemplated where either one or the other of a seat and a backrest are supported for recline range adjustment independent of the other. In addition, embodiments are contemplated that include different combinations of the features described above.

The present invention recognizes that a spring and coupler assembly can be used to provide an adjustable chair recline assembly using minimal and relatively inexpensive components so that recline features normally associated with relatively expensive chair assemblies may be provided in less expensive configurations. Further, the present inventive seating arrangement provides an uncomplicated design that may be easily and quickly assembled, is relatively inexpensive, is capable of a long operating life, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments presently claimed are as follows:

1. A seating arrangement, comprising:

a base support;

a support arrangement configured to support a seated user and movable between an upright position and a reclined position; and a spring arrangement positioned between the base support and the support arrangement, the spring arrangement comprising:

a first portion attached to the support arrangement;

a second portion attached to the base support;

an intermediate portion positioned between the first portion and the second portion;

a first spring member configured to bias the support arrangement from the reclined position toward the upright position;

a second spring member configured to bias the support arrangement from the reclined position toward the upright position, the second spring member spaced from the first spring member; and an adjustment member positioned between the first portion and the intermediate portion, the adjustment member adjustable between a first position where the first spring member exerts a first force on the first portion and the second spring exerts a second force on the intermediate portion, and a second position where the first spring member exerts a third force on the first portion that is different than the first force and the second spring exerts a fourth force on the intermediate portion that is different than the second force.

2. The seating arrangement of claim 1, wherein the first position is located rearwardly of the second position.

3. The seating arrangement of claim 1, wherein the third force is greater than the first force and the fourth force.

4. The seating arrangement of claim 1, wherein the first portion is pivotably coupled to the second portion.

5. The seating arrangement of claim 4, wherein the intermediate portion is pivotably coupled to the second portion.

6. The seating arrangement of claim 1, wherein the support arrangement includes a seat support arrangement.

7. The seating arrangement of claim 1, wherein the first portion, the second portion and the intermediate portion are located in a single vertical plane.

8. The seating arrangement of claim 1, wherein at least one of the first spring member and the second spring member comprises a cantilevered spring.

9. The seating arrangement of claim 1, wherein the first portion, the second portion and the intermediate portion each include a substantially straight section that are substantially parallel with one another when the support arrangement is in the upright position.

10. A seating arrangement, comprising:

a base support;

a support arrangement configured to support a seated user and movable between an upright position and a reclined position; and a spring arrangement positioned between the base support and the support arrangement, the spring arrangement comprising:

a first portion attached to the support arrangement;

a second portion attached to the base support;

a first spring member configured to bias the support arrangement from the reclined position toward the upright position, wherein the first portion and the second portion each include a substantially straight section that are substantially parallel with one another when the support arrangement is in the upright position and are not substantially parallel with one another when the support arrangement is in the reclined position, and wherein the first spring member includes a first U-shaped section extending between the first portion and the second portion; and an adjustment member positioned between the first portion and the second portion, the adjustment member adjustable between a first position where the first spring member exerts a first force on the first portion, and a second position where the first spring member exerts a second force on the first portion that is different than the first force.

11. The seating arrangement of claim 10, wherein the spring arrangement further comprises an intermediate portion positioned between the first portion and the second portion, and a second spring member configured to bias the support arrangement from the reclined position toward the upright position.

12. The seating arrangement of claim 11, wherein the second spring member includes a second U-shaped section extending between the second portion and the intermediate portion.

13. The seating arrangement of claim 12, wherein the second U-shaped section has a radius of curvature that is less that a radius of curvature of the first U-shaped section.

14. The seating arrangement of claim 11, wherein the second spring exerts a third force on the intermediate portion when the adjustment member is in the first position and a fourth force on the intermediate portion when the adjustment member is in the second position, and wherein the fourth force is different that the third force.

15. The seating arrangement of claim 10, wherein the spring arrangement further includes a second spring member configured to bias the support arrangement from the reclined position toward the upright position, and wherein the second spring includes a coil spring.

16. The seating arrangement of claim 15, wherein the spring arrangement further includes a pretensioning arrangement configured to pretension the coil spring between a first tension and a second tension that is greater than the first tension while the support arrangement remains in the upright position.

17. The seating arrangement of claim 10, wherein the first position is located rearwardly of the second position.

18. The seating arrangement of claim 10, wherein the second force is greater than the first force.

19. The seating arrangement of claim 10, wherein the support arrangement includes a seat support arrangement.

20. The seating arrangement of claim 10, wherein at least one of the first spring member comprises a cantilevered spring.

* * * * *